US009878194B2

(12) United States Patent
Young

(10) Patent No.: US 9,878,194 B2
(45) Date of Patent: Jan. 30, 2018

(54) FLUID DISPLACEMENT STATIONARY EXERCISE EQUIPMENT WITH CONTINUOUSLY VARIABLE TRANSMISSION

(71) Applicant: Calgym Group Holdings Pty. Ltd., Queensland (AU)

(72) Inventor: Leo Young, Queensland (AU)

(73) Assignee: CALGYM GROUP HOLDINGS PTY. LTD., Currumbin, Queensland (AU)

( * ) Notice: Subject to any disclaimer, the term of this patent is extended or adjusted under 35 U.S.C. 154(b) by 86 days.

(21) Appl. No.: 15/045,195

(22) Filed: Feb. 16, 2016

(65) Prior Publication Data

US 2017/0157445 A1 Jun. 8, 2017

Related U.S. Application Data

(60) Provisional application No. 62/264,270, filed on Dec. 7, 2015.

(51) Int. Cl.
*A63B 21/008* (2006.01)
*A63B 21/00* (2006.01)
(Continued)

(52) U.S. Cl.
CPC ..... *A63B 21/008* (2013.01); *A63B 21/00069* (2013.01); *A63B 21/0084* (2013.01); *A63B 21/0088* (2013.01); *A63B 21/152* (2013.01); *A63B 21/157* (2013.01); *A63B 21/158* (2013.01); *A63B 21/22* (2013.01); *A63B 21/4034* (2015.10); *A63B 22/0056* (2013.01); *A63B 22/04* (2013.01); *A63B 22/0605* (2013.01); *A63B 24/0087* (2013.01); *A63B 21/154* (2013.01); *A63B 71/0619* (2013.01); *A63B 2208/0204* (2013.01); *A63B 2208/0228* (2013.01); *A63B 2209/08* (2013.01); *A63B 2220/20* (2013.01); *A63B 2220/36* (2013.01); *A63B 2220/58* (2013.01); *A63B 2225/50* (2013.01); *A63B 2230/75* (2013.01)

(58) Field of Classification Search
CPC ..... A63B 21/008; A63B 21/4034; A63B 21/00069; A63B 21/0088; A63B 21/152; A63B 21/154; A63B 21/157; A63B 21/158; A63B 21/22; A63B 22/04; A63B 22/0605; A63B 24/0087; A63B 2208/0204; A63B 2208/0228
See application file for complete search history.

(56) References Cited

U.S. PATENT DOCUMENTS

2005/0085348 A1* 4/2005 Kiefer ..... A63B 22/0076 482/72
2012/0277071 A1* 11/2012 Lin ..... A63B 21/0084 482/111
2013/0337981 A1* 12/2013 Habing ..... A63B 21/22 482/110

* cited by examiner

*Primary Examiner* — Andrew S Lo
(74) *Attorney, Agent, or Firm* — Chun-Ming Shih

(57) ABSTRACT

A stationary exercise equipment has a supporting structure, a movable user interface connected to the supporting structure, and a force-resisting device. The force-resisting device with a hub mounted continuously variable transmission configured therein provides a variable resistance force that varies an amount of force with a movement of the movable user interface. The hub mounted variable transmission is operably to vary the resistance force of the movable user interface in a manner of varying a rotational rate of the user interface to increase or decrease as required.

12 Claims, 29 Drawing Sheets

(51) Int. Cl.

| | |
|---|---|
| ***A63B 21/22*** | (2006.01) |
| ***A63B 22/04*** | (2006.01) |
| ***A63B 22/06*** | (2006.01) |
| ***A63B 24/00*** | (2006.01) |
| ***A63B 22/00*** | (2006.01) |
| *A63B 71/06* | (2006.01) |

FLUID DISPLACEMENT STATIONARY EXERCISE EQUIPMENT WITH CONTINUOUSLY VARIABLE TRANSMISSION

BACKGROUND

1. Technical Field

The technical field relates to stationary exercise equipment which utilizes techniques of continuously variable transmission and fluid displacement to provide a suitable amount of workout for any user. The user controls the workout intensity by adjusting the ratio of the transmission via a small control knob.

2. Background of the Invention

Traditional fluid displacement stationary exercise equipment is a compromise for most users due to the pre-set ratios of pulleys, gears or sprockets. This means that a novice may find the workout too challenging, whilst an elite athlete may find the workout insufficient. A rehabilitation client who has to exercise with a light load will also find these products difficult to use or too taxing for their level of ability. This limits the practical range of users.

Many stationary physical exercise apparatuses using fluid (air, liquid or both) displacement resistance, have been designed in the past, and incorporated with a turbine to provide that resistance.

The user interface (handles, foot pedals, foot plates, ropes, chains etc.) is/are connected to the turbine (air, liquid or both) via a series of pulleys, gears or sprockets with cable or chain. In conventional equipment, the ratio of these pulleys, gears or sprockets are fixed.

This fixed ratio arrangement then defines the system mechanical resistance as a compromise for all users, whether the user is a novice or an elite athlete. Thus, these products, based on fluid displacement resistance, are only useful over a small range of input cadence.

When operating the displacement turbine, the energy input required verses the turbine speed is not linear. Increasing turbine speed requires ever increasing input power.

In conventional equipment, the values for calories of input energy expended and watts produced reported by the equipment is taken from a look up table which has been built from a formula that describes the relationship between the user interface crank and the turbine speed.

The graph in FIG. 26 charts the cube power relationship curve between Pedal Cadence and Energy Input, for a commercial gym sample Air Displacement Bike against linear axes.

Whilst providing a good though less that optimum work out, this non-linear relationship, makes a typical fluid (air, liquid or both) displacement exercise machine difficult for a user on a number of levels.

The power curve shows that for a given user, the useful cadence range is very limited to a small or compressed range.

It becomes very difficult for an elite athlete to measure small incremental improvements in performance. The elite athlete may also find that the workout is inadequate for their requirements.

For the novice or beginner, this non-linear relationship, and increasing difficulty of use, contributes to early fatigue and retirement from using the fluid displacement machine and possibly from exercise in general. The novice or beginner may also find that the power required is too demanding for their abilities.

A rehabilitation client, under direction of their health professional may be required to exercise at moderate to high speed but with a light load, however this non-linear relationship, and increasing difficulty of use, may prevent the practical use in therapy sessions. The novice or beginner or rehabilitation client may also find that the power required is too demanding for their abilities.

The general user may only be able to produce a few hundred watts, whilst an elite athlete may produce up to 3,000 watts. Each of these users is then operating over a very small range of the power curve, however no single other machine can provide the comfortable power range which is required.

Thus, attempts have been made in the past to introduce gearing systems, for example derailleur gear change systems similar to what may be used on a road bicycle. These have proved difficult to use with some overlap between the ratios.

BRIEF SUMMARY OF THE INVENTION

The purpose of a preferred embodiment of the present invention is to provide stationary exercise equipment which utilizes techniques of a continuously variable transmission and fluid displacement to provide a suitable amount of workout for any user.

The preferred embodiment of the present invention incorporates a Continuously Variable Transmission (CVT) between the driven displacement turbine and the driving source (pedals, handles, crank etc.) in the fluid (air, liquid or both) displacement machine.

Preferably, the stationary exercise equipment has a supporting structure; a force-resisting device situated inside the supporting structure; a hub mounted continuously variable transmission installed on the force-resisting device; a movable user interface installed on the supporting structure for controlling a transmission ratio; a main shaft penetrating through a main sprocket, two ends of the main shaft being sleeved with a first sprocket and a second sprocket, respectively; a plurality of front pulleys and a plurality of rear pulleys correspondingly connected thereto; a plurality of flexible cables fed to the plurality of front pulleys and further linked to a plurality of chains; and another chain engaging the main sprocket and the hub mounted continuously variable transmission. Wherein, the plurality of chains engage the first sprocket and the second sprocket to drive the main sprocket, so that another chain engaging the main sprocket and the hub mounted continuously variable transmission can be driven to bring the force-resisting device into rotation.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
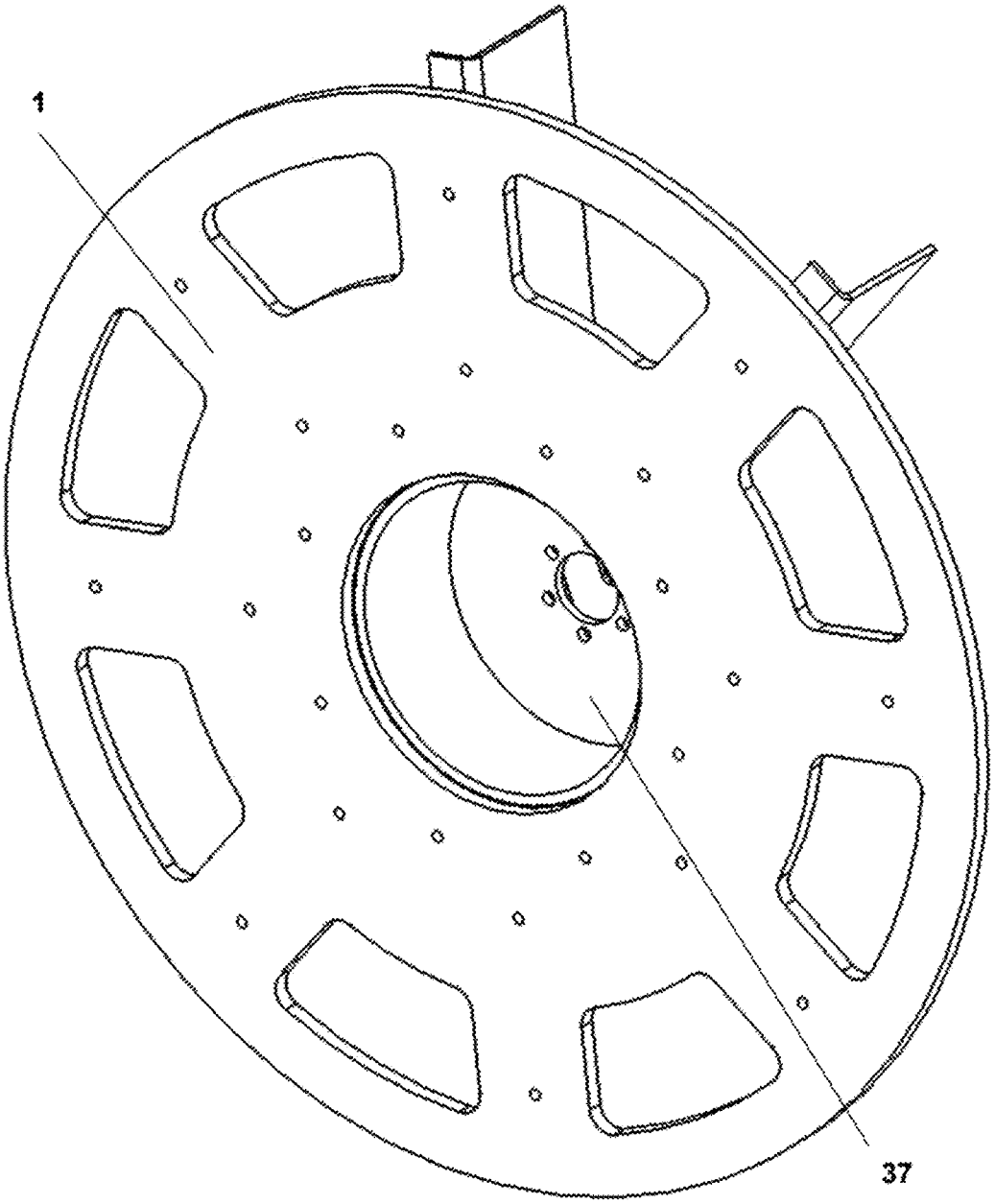
FIG. 1 is a schematic view of a preferred embodiment of the force-resisting device of a stationary exercise equipment according to the present invention.
Figure 2:
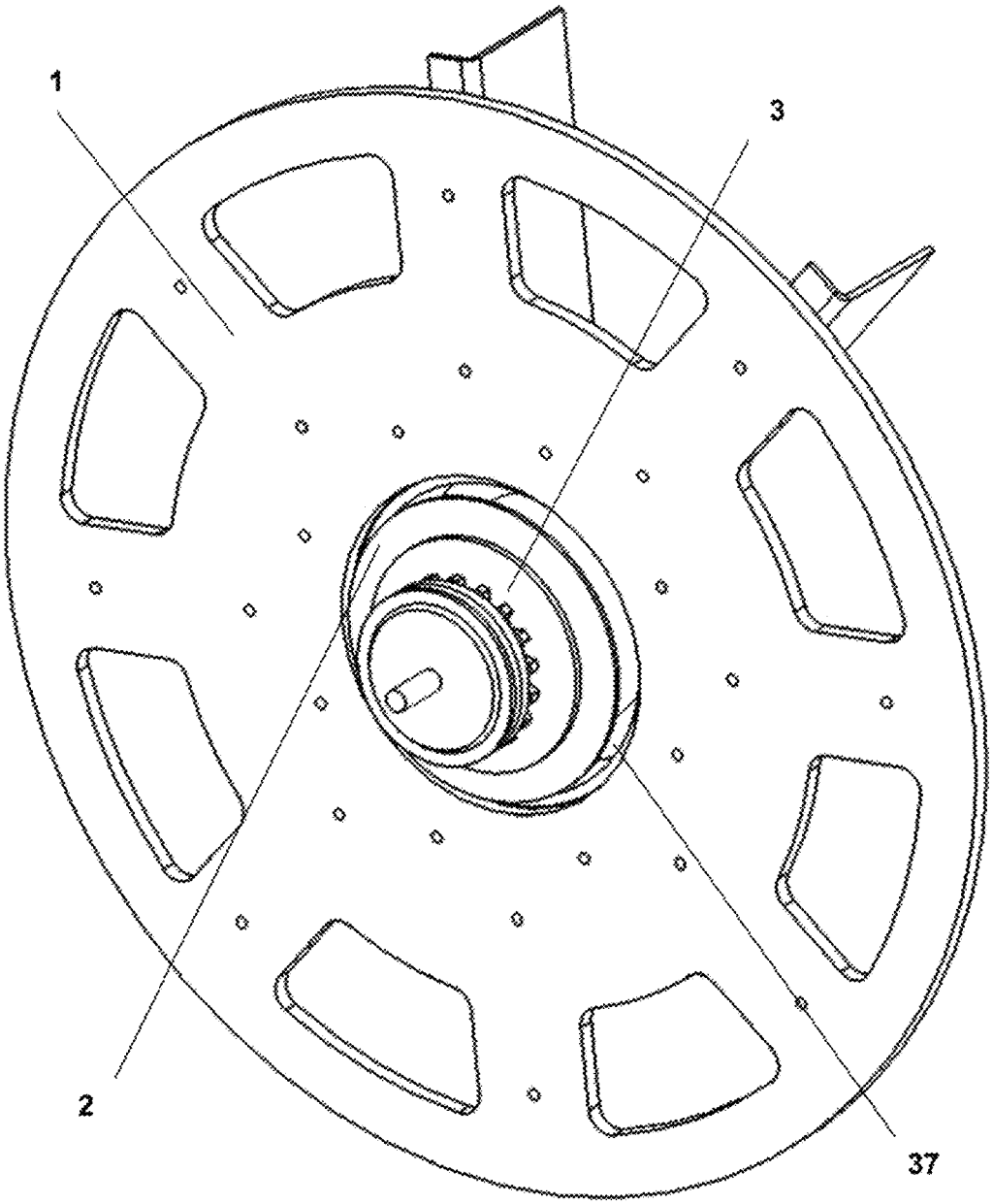
FIG. 2 is a schematic view of the preferred embodiment of the present invention showing the force-resisting device with the hub mounted continuously variable transmission installed.
Figure 3:
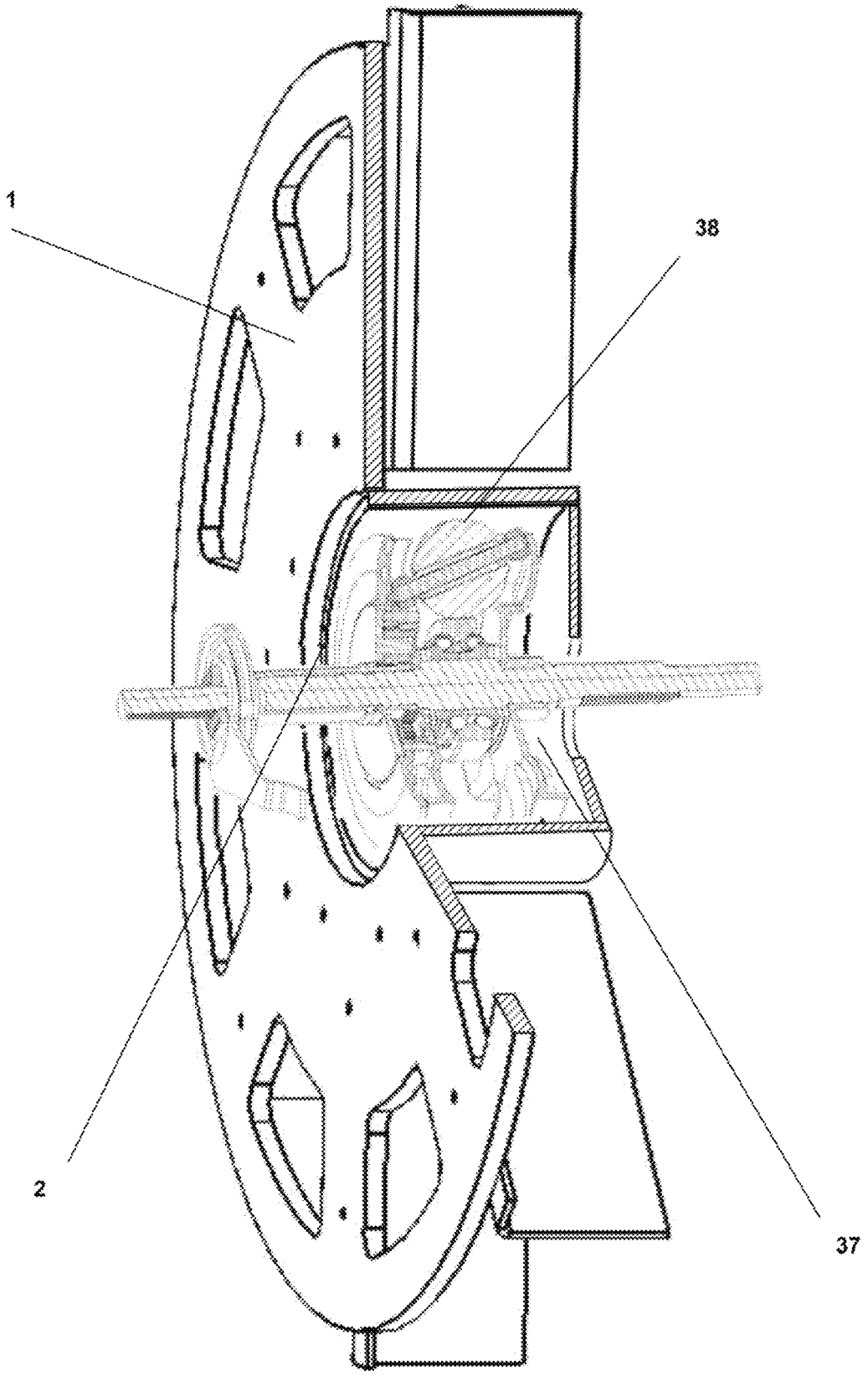
FIG. 3 is a sectional view of a preferred embodiment of the hub mounted continuously variable transmission and the force-resisting device according to the present invention.
Figure 4:
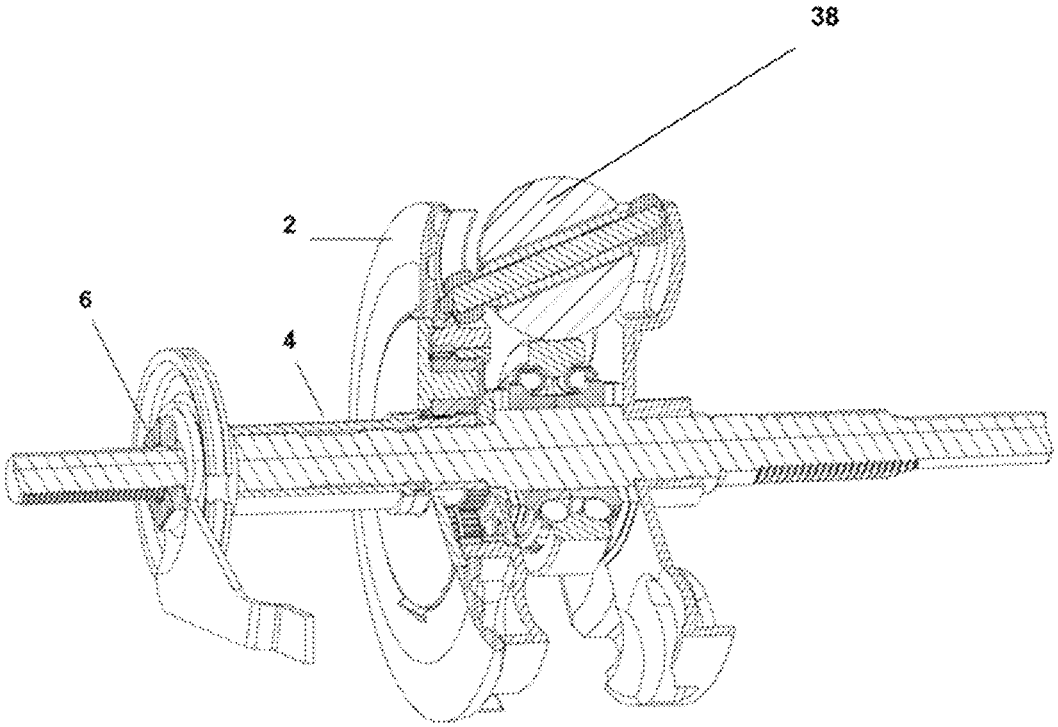
FIG. 4 is a sectional view of a preferred embodiment of the hub mounted continuously variable transmission according to the present invention.

Referring to FIGS. 1 and 2, which show a force-resisting device (1) of the stationary exercise equipment according to the present invention. The force-resisting device (1) is formed in wheel shape and has an accommodation space (37) at the center thereof. Preferably, the force-resisting device (1) can be an air displacement turbine. Magnetic sensors (not shown in the FIG.), strategically located in the fluid (air, liquid or both) displacement turbine, can detect the speed for the user interface and the displacement turbine, and these speeds are then used to calculate input power required and calories spent. A hub mounted continuously variable transmission (2) is accommodated inside the accommodation space (37). The hub mounted continuously variable transmission (2) has a transmission drive sprocket (3) coaxially disposed thereon. FIG. 3 is a cross sectional view showing the force-resisting device (1) and the hub mounted continuously variable transmission (2) inside the accommodation space (37). FIG. 4 is a cross sectional view showing the hub mounted continuously variable transmission (2). A transmission input shaft spline (4) penetrates through the center of the hub mounted continuously variable transmission (2), and a transmission ratio selector input control (7) is coaxially sleeved on one end of the transmission input shaft spline (4). A transmission ratio selector collar (6) clips on the transmission input shaft spline (4) against the transmission ratio selector input control (7) to prevent the transmission ratio selector input control (7) from sliding out of the transmission input shaft spline (4). An internal mechanism consisting of seven planetary spheres (38) is installed inside the hub mounted continuously variable transmission (2) to continuously change the transmission ratio. The planetary spheres (38) is used to transmit power from the transmission input to the transmission output which is coupled to the force-resisting device (1). The construction of the transmission causes the driving edge of each planetary sphere (38) to track the opposite location to the driven edge location, causing the ratio of transmission to vary as the location of the contact with the driven edge of each planetary sphere (38) changes. The driven edge location is variable and selected by an interface which is both pushed and pulled by Bowden Cables, as shown in FIGS. 8 and 9.

Figure 5:
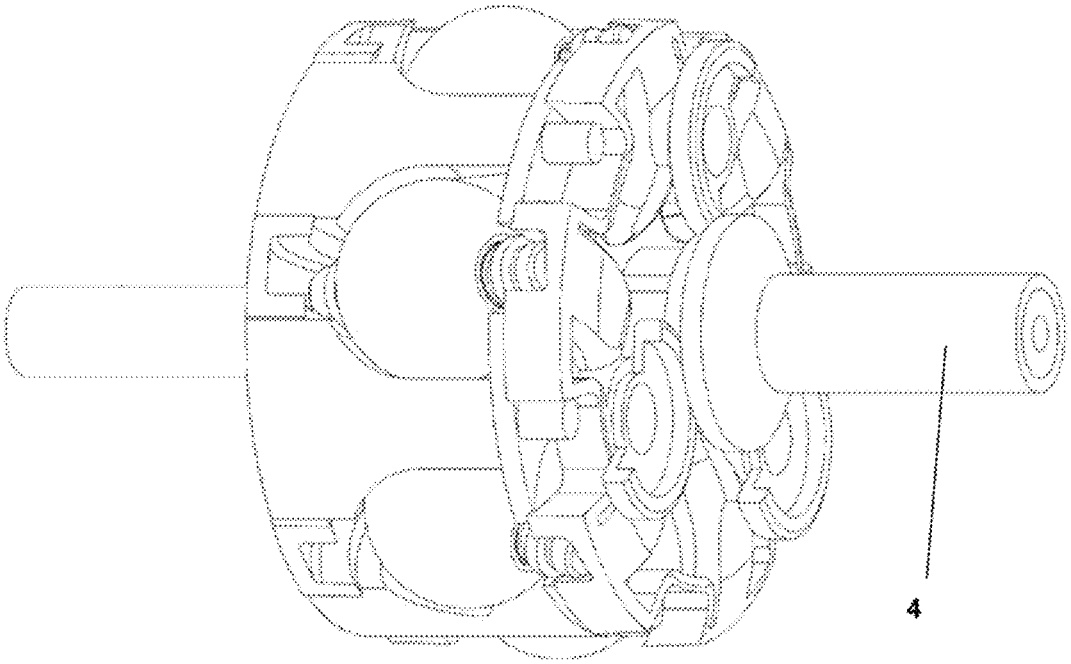
FIG. 5 is a sectional view of a preferred embodiment of the hub mounted continuously variable transmission, showing the planetary spheres according to the present invention.
Figure 6:
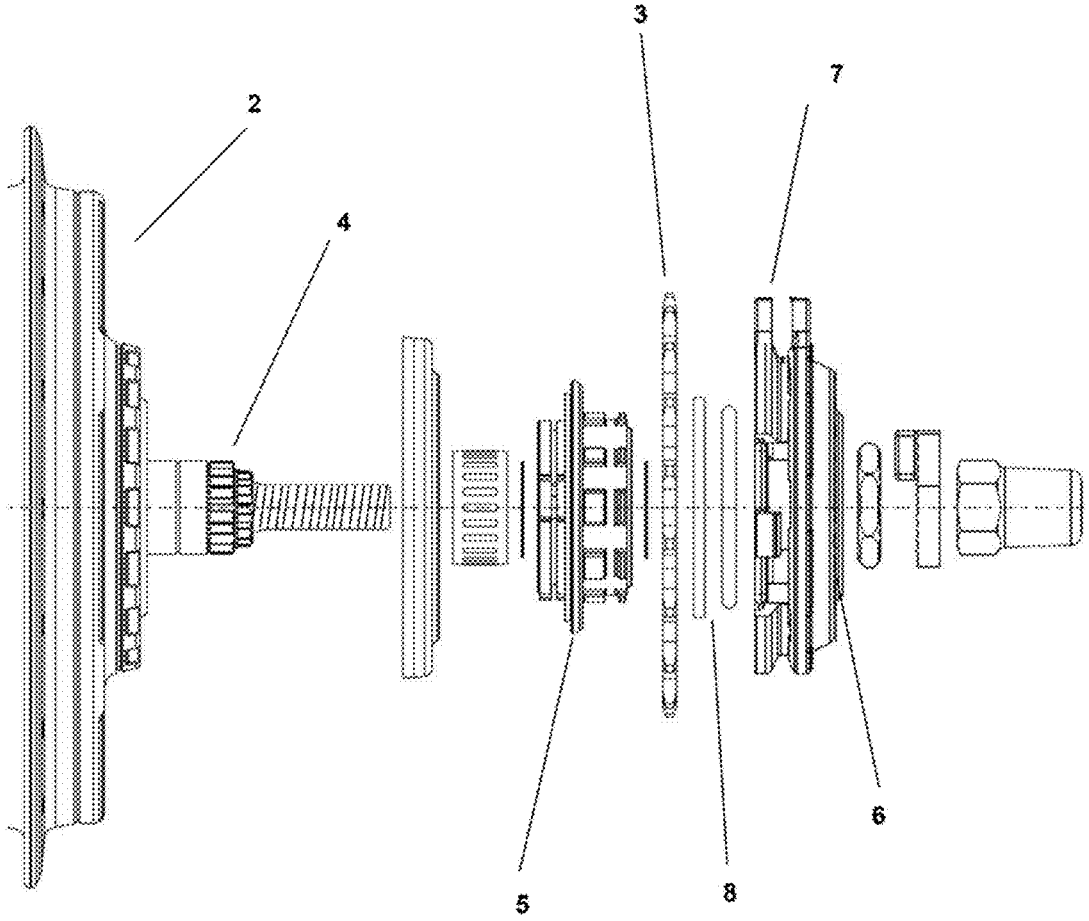
FIG. 6 is lateral view of a preferred embodiment of the hub mounted continuously variable transmission, the transmission input drive sprocket, the transmission input shaft spline, a transmission input unidirectional clutch, the transmission ratio selector collar, the transmission ratio selector input control and the transmission ratio selector input control spacers according to the present invention.

FIG. 5 is in internal view of the transmission assembly showing the planetary spheres (38) and the input shaft (4). FIG. 6 shows the exploded view of the input section of the hub mounted continuously variable transmission (2), the transmission input drive sprocket (3), the transmission input shaft spline (4), a transmission input unidirectional clutch (5), the transmission ratio selector collar (6), the transmission ratio selector input control (7) and a plurality of transmission ratio selector input control spacers (8). The transmission input unidirectional clutch (5), the transmission input drive sprocket (3), the plurality of transmission ratio selector input control spacers (8), the transmission ratio selector input control (7), and the transmission ratio selector collar (6) are sequentially and coaxially sleeved on the transmission input shaft spline (4) toward the hub mounted continuously variable transmission (2).

Figure 7:
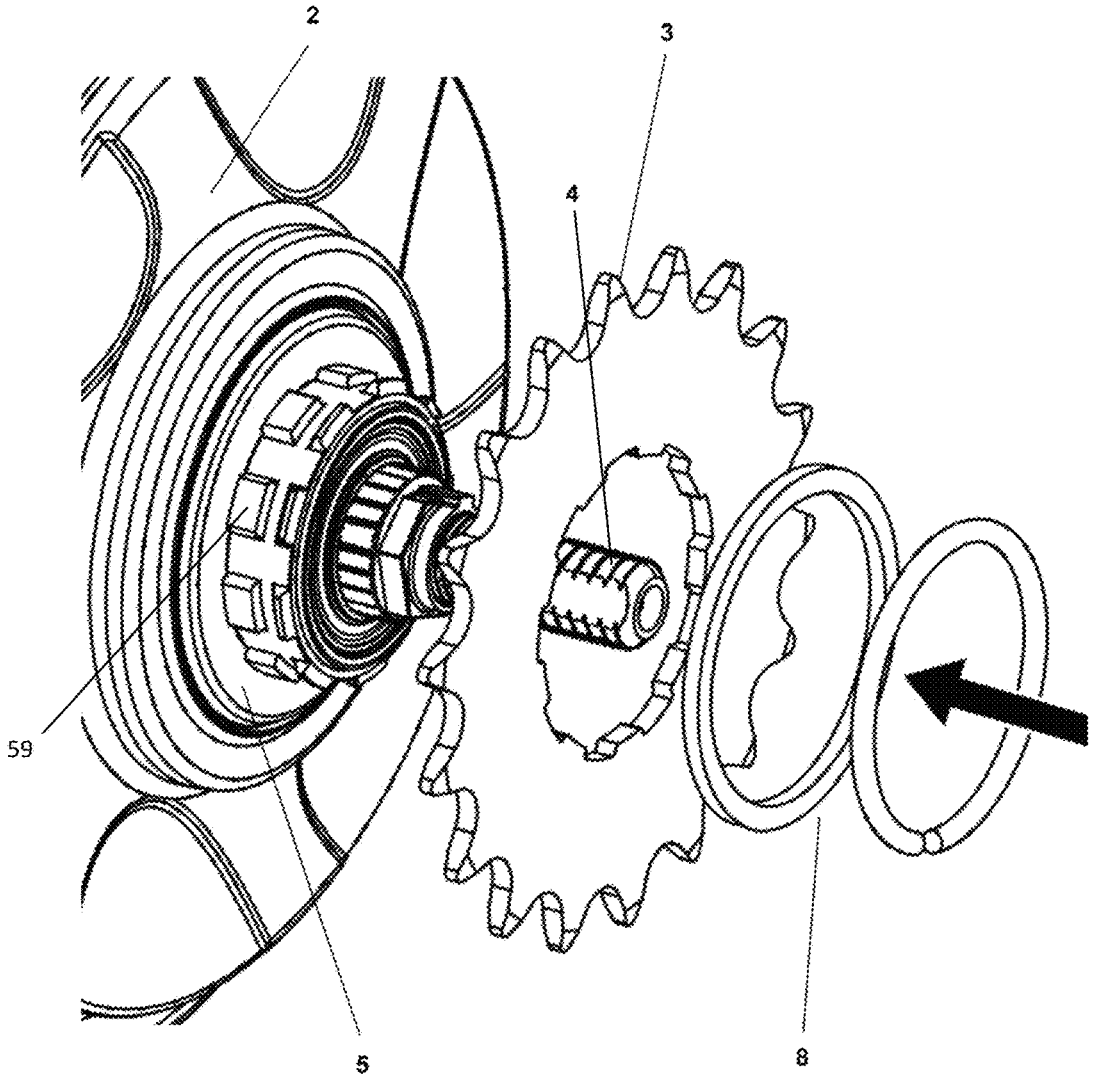
FIG. 7 is a schematic view of the preferred embodiment of the hub mounted continuously variable transmission and the transmission input drive sprocket according to the present invention.

More specifically, as shown in FIG. 7, the center of the transmission input drive sprocket (3) has formed a hollow section which has a tooth shape outer periphery. An outer periphery of the transmission input unidirectional clutch (5) is protruded to form a plurality of convex parts (59) which are corresponding to the tooth shape outer periphery of the hollow section of the transmission input drive sprocket (3). After being assembled, the transmission input drive sprocket (3) and the transmission input unidirectional clutch (5) can rotate simultaneously.

Figure 8:
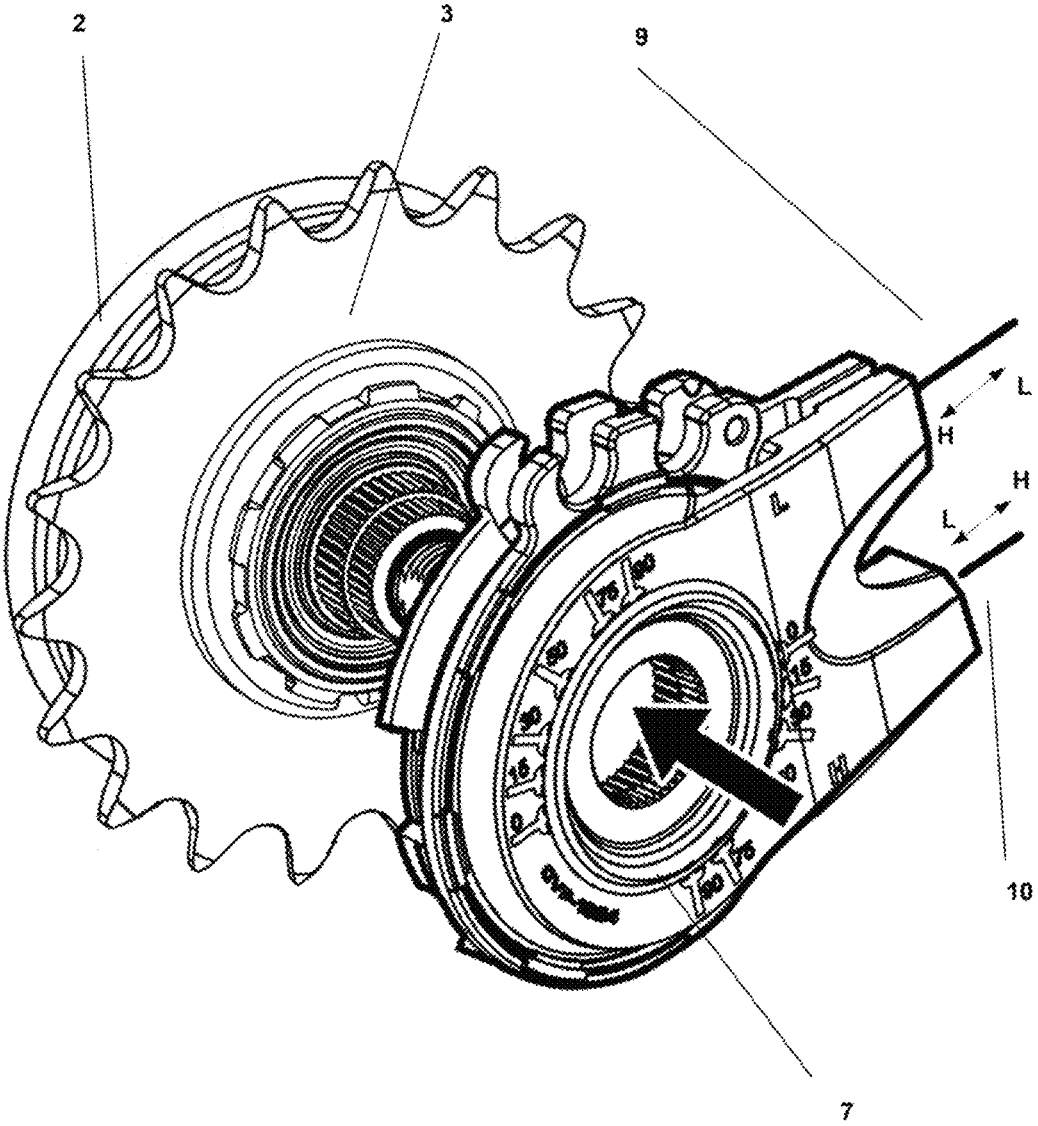
FIG. 8 is a schematic view of the preferred embodiment of the hub mounted continuously variable transmission, the transmission input drive sprocket, and the transmission ratio selector input control according to the present invention.
Figure 9:
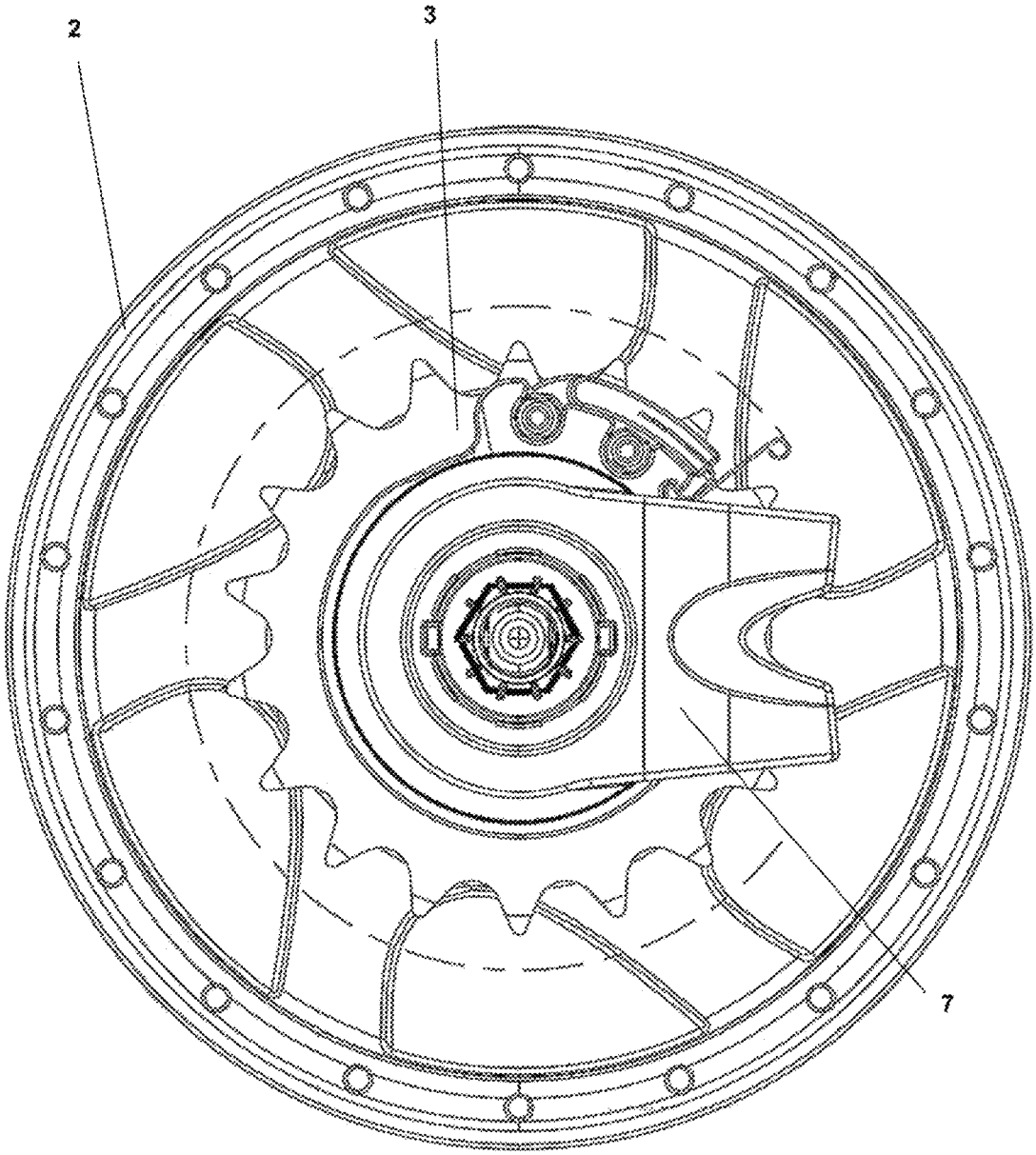
FIG. 9 is a sectional view of the preferred embodiment of the hub mounted continuously variable transmission, the transmission input drive sprocket, and the transmission ratio selector input control according to the present invention.

Referring to FIGS. 8 and 9, two Bowden cables (9) and (10) are linked to the transmission ratio selector input control (7). The two Bowden cables (9) and (10) are used to adjust the transmission ratio from high to low and from low to high, respectively.

Figure 10:
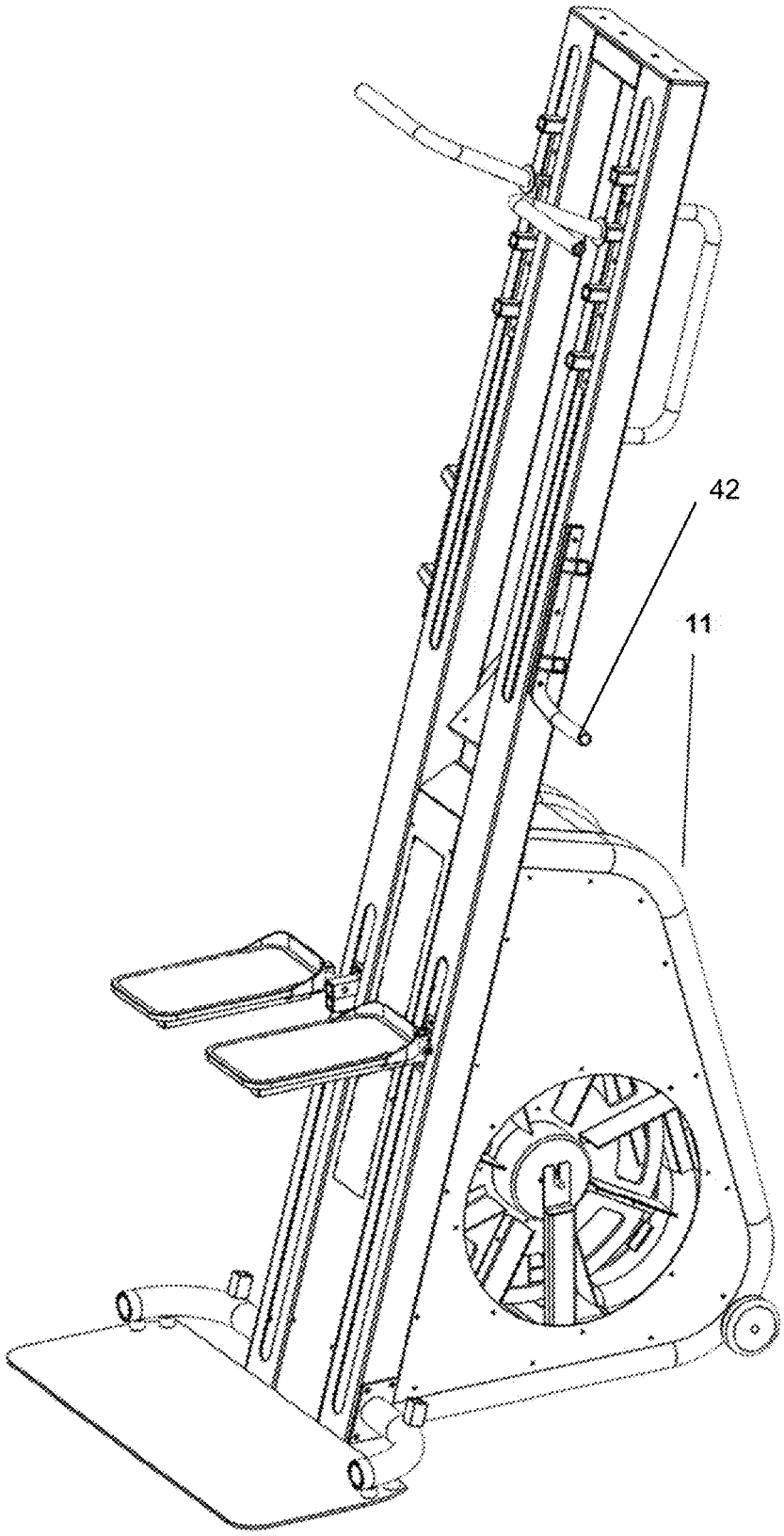
FIG. 10 is schematic view of the preferred embodiment of the stationary exercise equipment according to the present invention.
Figure 11:
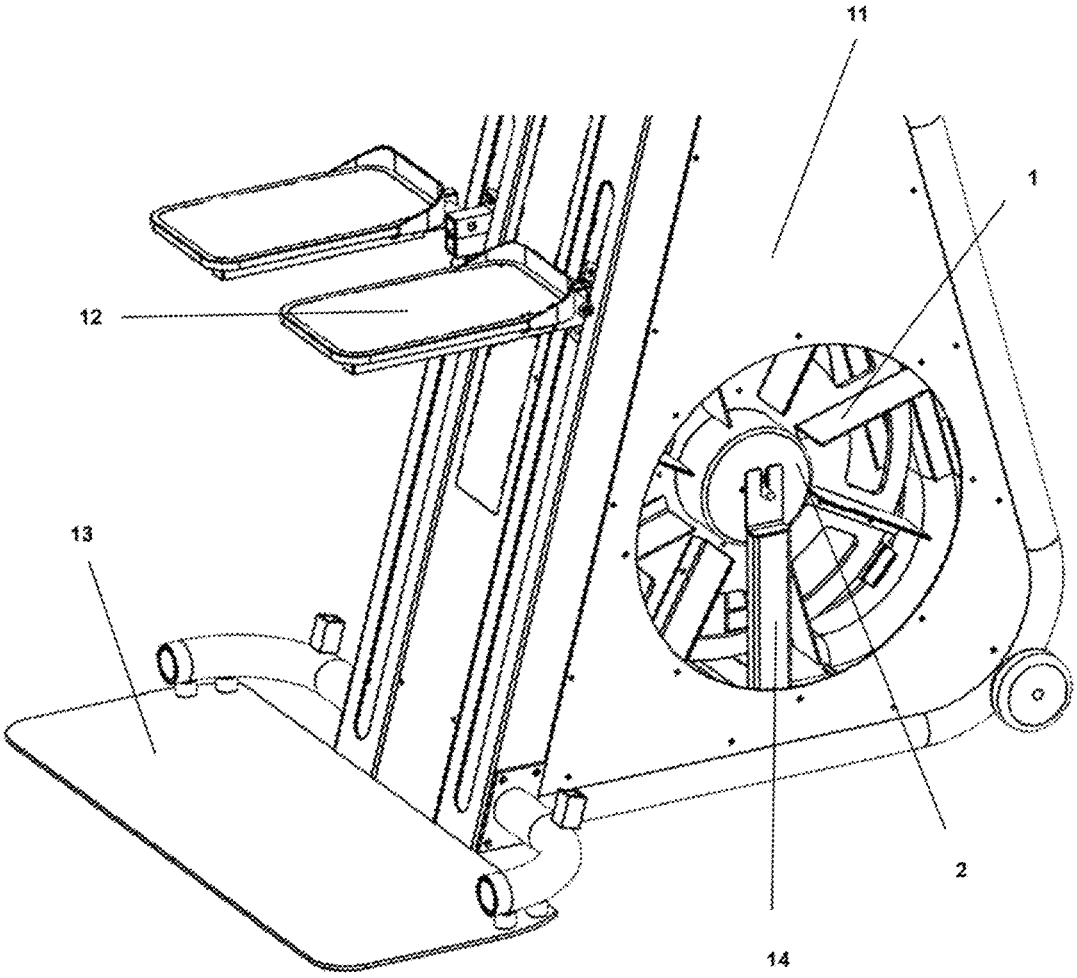
FIG. 11 is another partial schematic view of the preferred embodiment of the stationary exercise equipment according to the present invention.

FIGS. 10 and 11 show one of the preferred embodiments of the stationary exercise equipment according to the present invention. A turbine mount (14) installed inside a tower stand (11) is used for supporting the force-resisting device (1), and a pair of foot plates (12) is installed on the tower stand (11) for the users to step thereon. Furthermore, an equipment stability pedestal (13) is provided at the bottom of the tower stand (11) to stabilize the tower stand (11). It is noted that, the tower stand (11) is merely a supporting structure for accommodating the aforementioned elements, and thus the supporting structure can be formed in any shape and size as long as the stationary exercise equipment according to the present invention can safely do the work.

Figure 12:
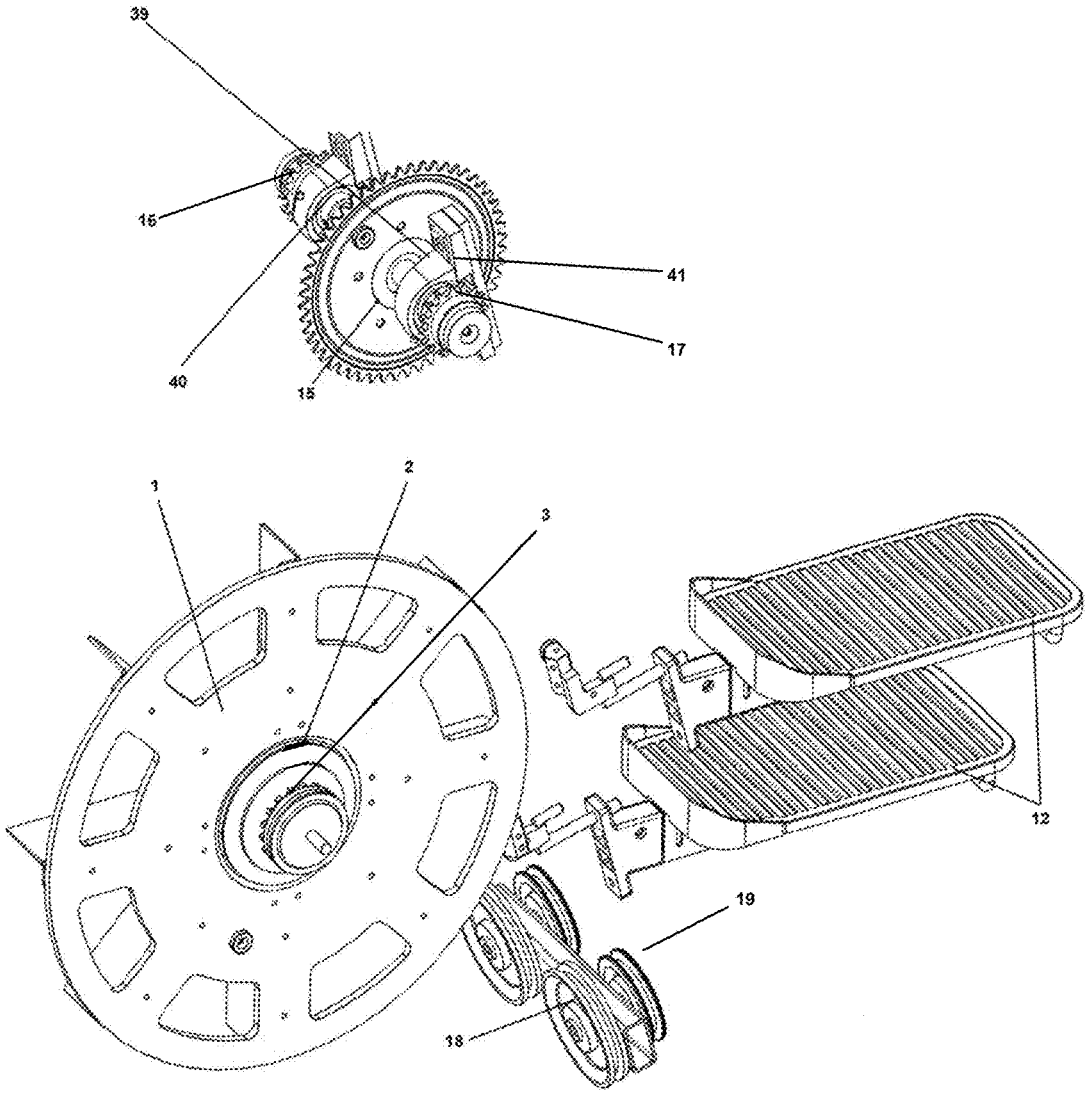
FIG. 12 is an exploded perspective view of the preferred embodiment of the stationary exercise equipment according to the present invention.
Figure 13:
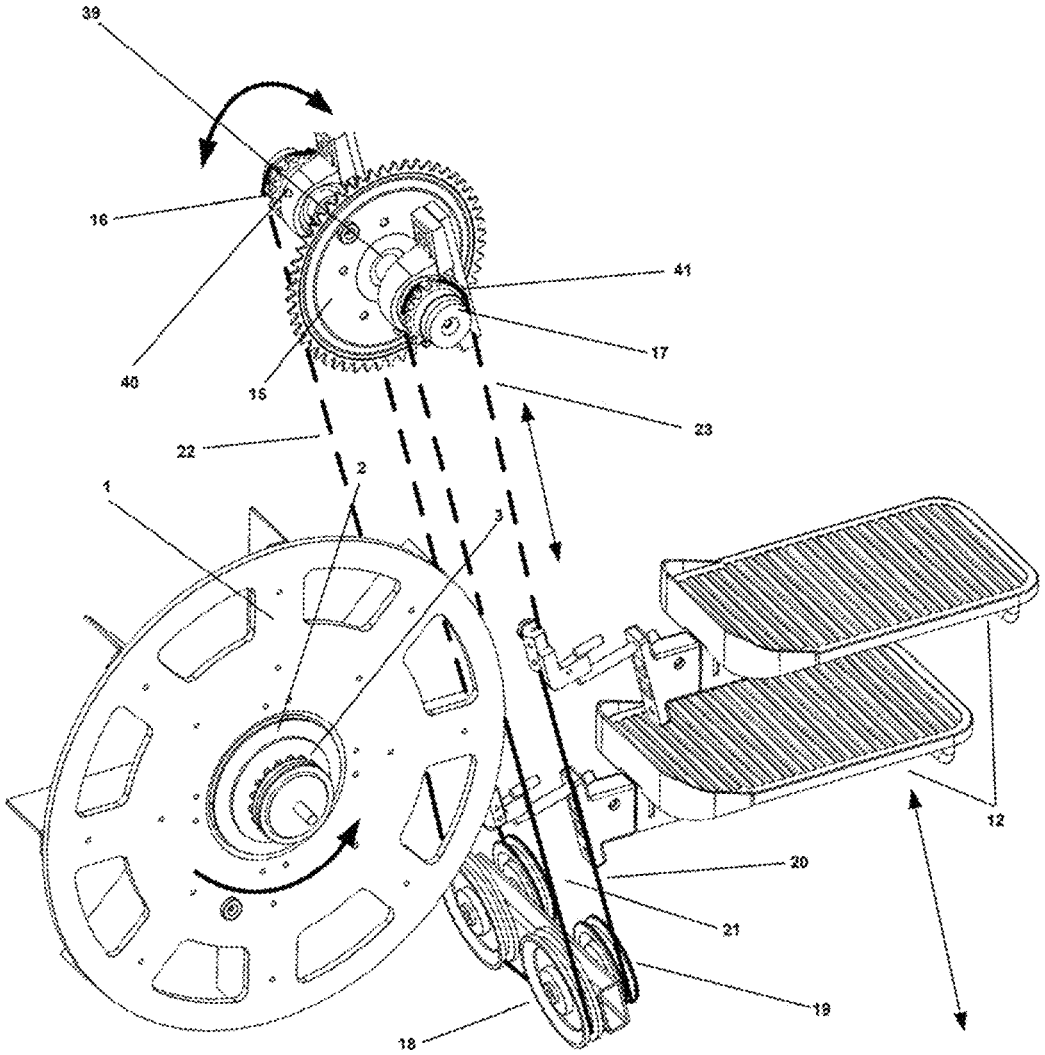
FIG. 13 is another exploded perspective view of the preferred embodiment of the stationary exercise equipment according to the present invention.
Figure 14:
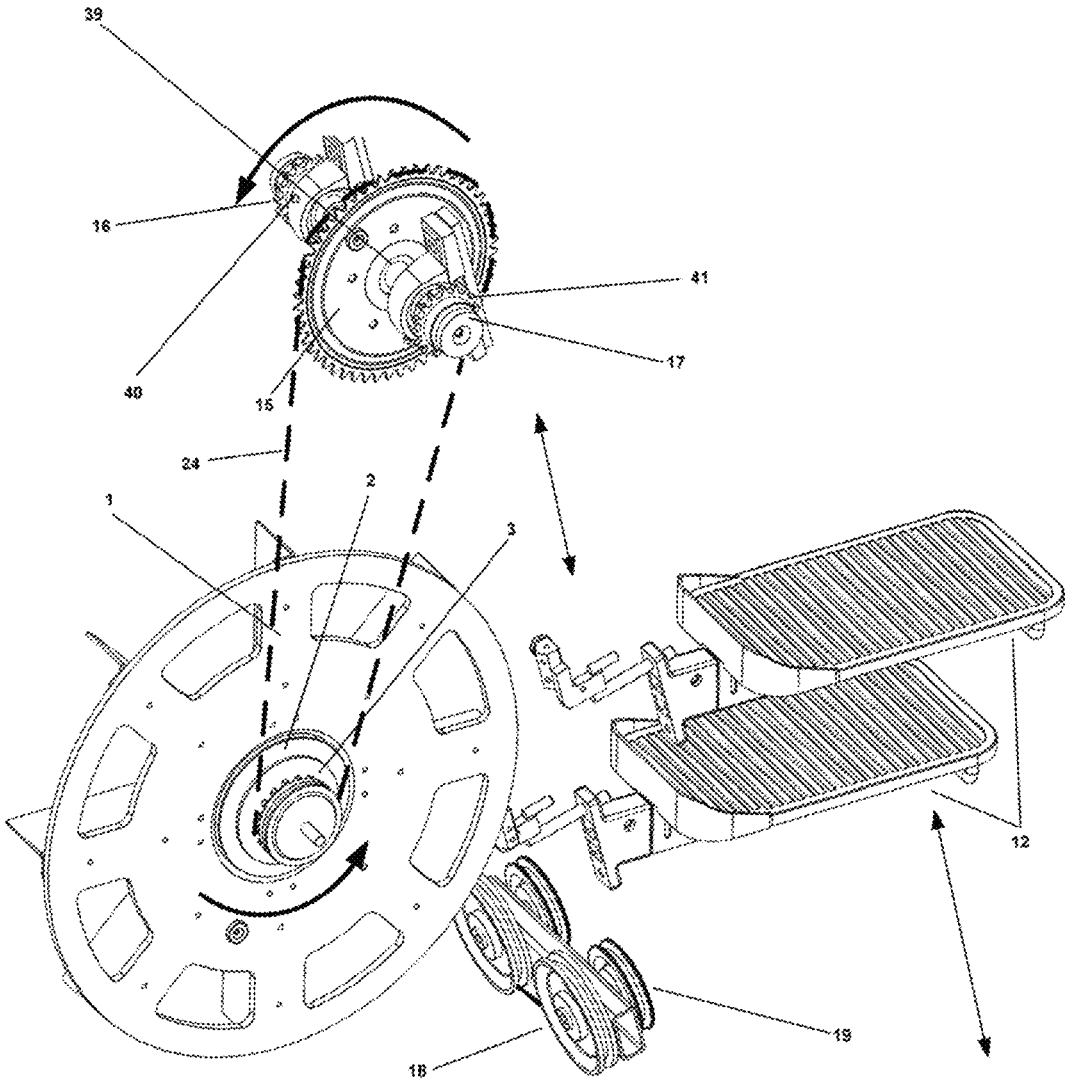
FIG. 14 is still another exploded perspective view of the preferred embodiment of the stationary exercise equipment according to the present invention.

Referring to FIGS. 12 to 14, which are illustrations of how the force-resisting device (1) works with the user foot plates (12). Two ends of a main shaft (39) penetrating the center of a main sprocket (15) are provided with a first sprocket (16) and a second sprocket (17) respectively. Foot plates (12) travel at an angle of 75° along sliding rails of the tower stand (11) (not shown in the FIG.). The Foot plates (12) are coupled to a first chain (22) and a second chain (23). A first flexible cable (20) and a second flexible cable (21) are fed to a front pulley (19) and a rear pulley (18) respectively, and then the first flexible cable (20) and the second flexible cable (21) are coupled to the first chain (22) and the second chain (23) which are fed to sprocket (16) coupled to the main shaft (39) via an unidirectional clockwise clutch (40), and to sprocket (17) coupled to the main shaft (39) via an unidirectional counter clockwise clutch (41). The main shaft (39) rotates in the counter clockwise direction when viewed from the left, as shown in FIG. 13. The first chain (22) and the second chain (23) are coupled to the first flexible cables (20) and the second flexible cable (21). The main shaft (39) drives the main sprocket (15) in the counter clockwise direction when viewed from the left, as shown in FIG. 14. The main sprocket (15) is coupled via chain (24) to the transmission sprocket (3), which drives the hub mounted continuously variable transmission (2) to rotate accordingly, so that the force-resisting device (1) further rotates in the counter clockwise direction under the control of the hub mounted continuously variable transmission (2).

Figure 15:
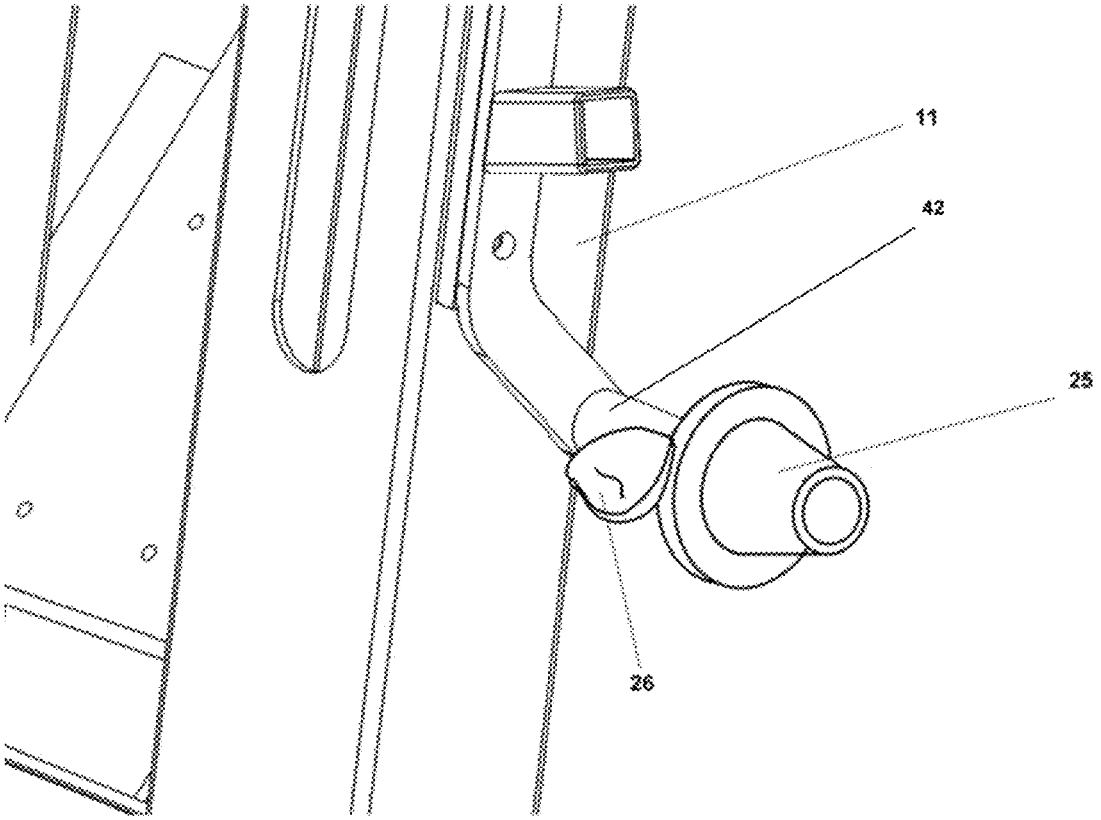
FIG. 15 is a partially enlarged view of the preferred embodiment of the movable user interface of the stationary exercise equipment according to the present invention.
Figure 16:
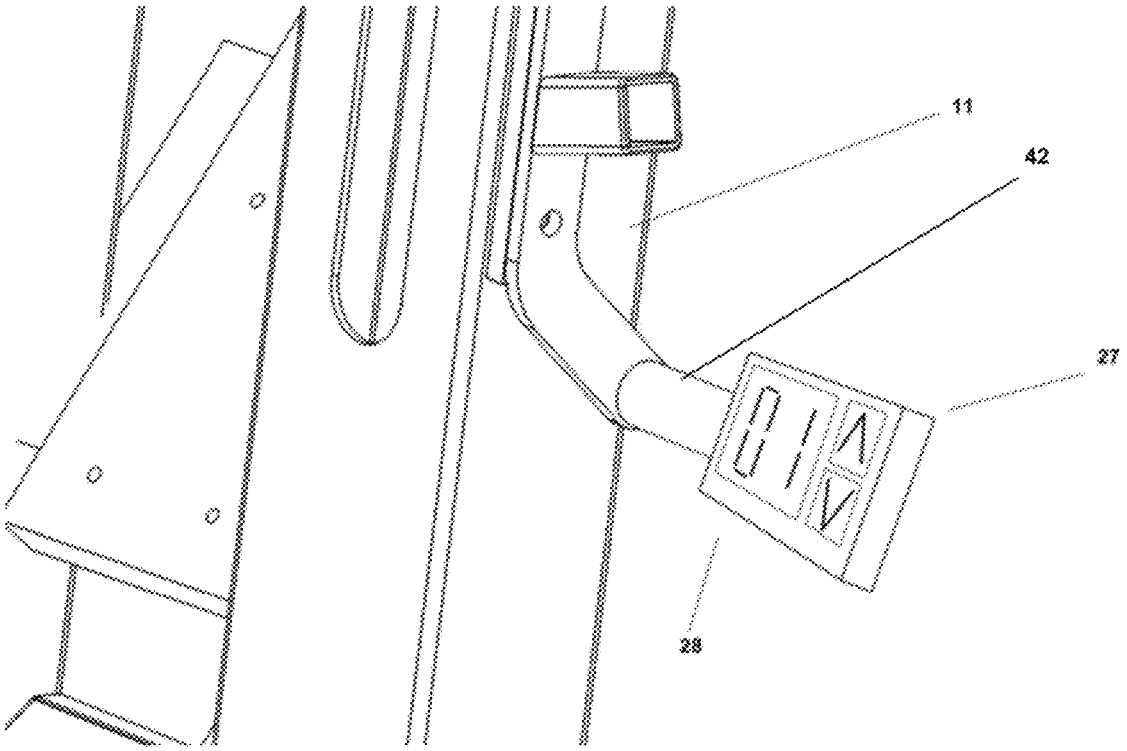
FIG. 16 is another partially enlarged view of the preferred embodiment of the movable user interface of the stationary exercise equipment according to the present invention.
Figure 17:
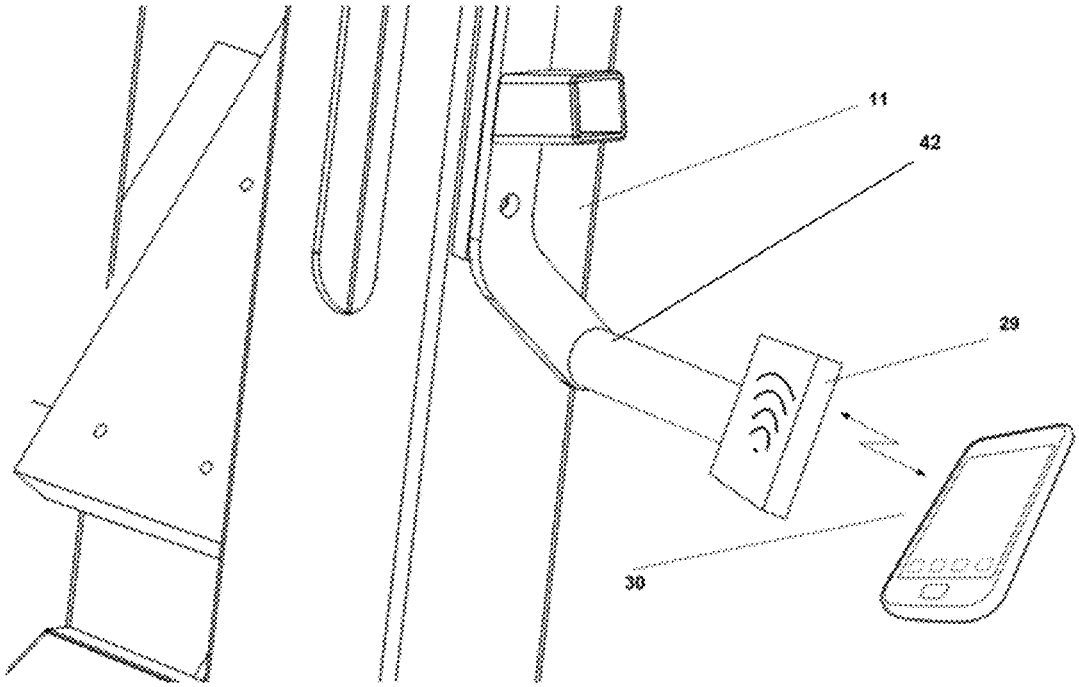
FIG. 17 is still another partially enlarged view of the preferred embodiment of the movable user interface of the stationary exercise equipment according to the present invention.

Referring to FIGS. 15 to 17, a movable user interface is installed on the tower stand (11) for controlling the transmission ratio. It is noted that, the movable user interface (42) can be a wired or wireless controller, which can be manually, remotely, electrically, hydraulically, pneumatically controlled, or the combinations of thereof, such as manual transmission ratio control knob (25) with difficulty display (26) (FIG. 15), electric transmission ratio control panel (27) with difficulty display (28) (FIG. 16), or wireless transmission ratio control panel (29) with the smart phone controller (30) (FIG. 17). Therefore, the hub mounted variable transmission (2) is operably to vary the resistance force of the movable user interface in a manner of varying a rotational rate of the user interface to increase or decrease as required. For example, the commercially available, hub mounted Continuously Variable Transmission, has an adjustment ratio range of 1:1 to 3.6:1. This range of ratio, and the careful selection of intermediate sprockets, has proved to be able to deliver the optimum workout for any user. More specifically, a Continuously Variable Transmission ratio of 1:1 sets the displacement turbine at its lowest speed for a given input cadence. A Transmission ratio of 3.6:1 sets the displacement turbine at its highest speed for a given input cadence. Therefore, the hub mounted Continuously Variable Transmission offers a smooth and seamless shift with no steps, through an infinite number of effective gear ratios from low to high within the wide 360% ratio range.

Figure 18:
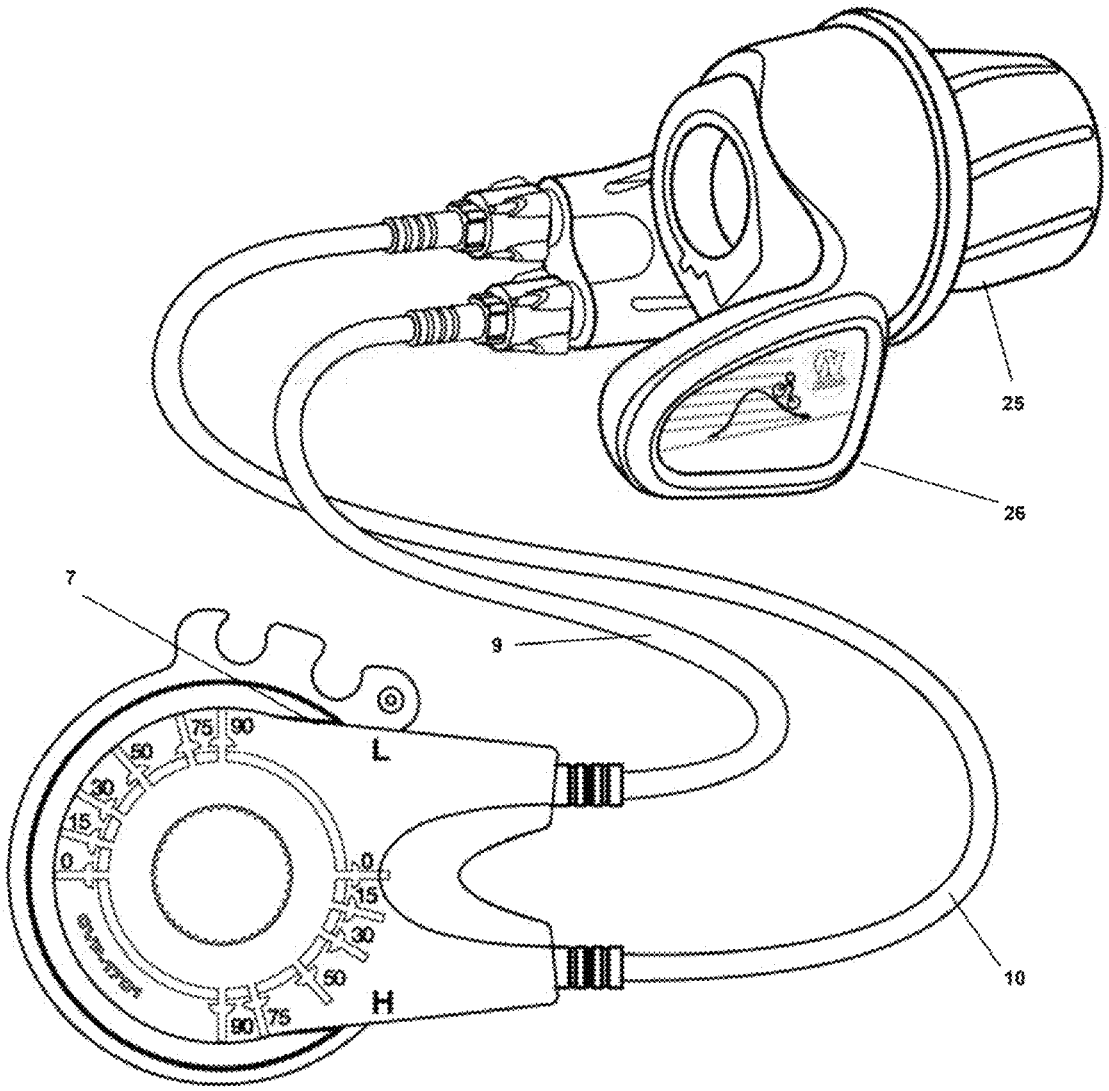
FIG. 18 is a partially enlarged view of the preferred embodiment of the movable user interface, the Bowden cable, and the transmission ratio selector input control of the stationary exercise equipment according to the present invention.
Figure 19:
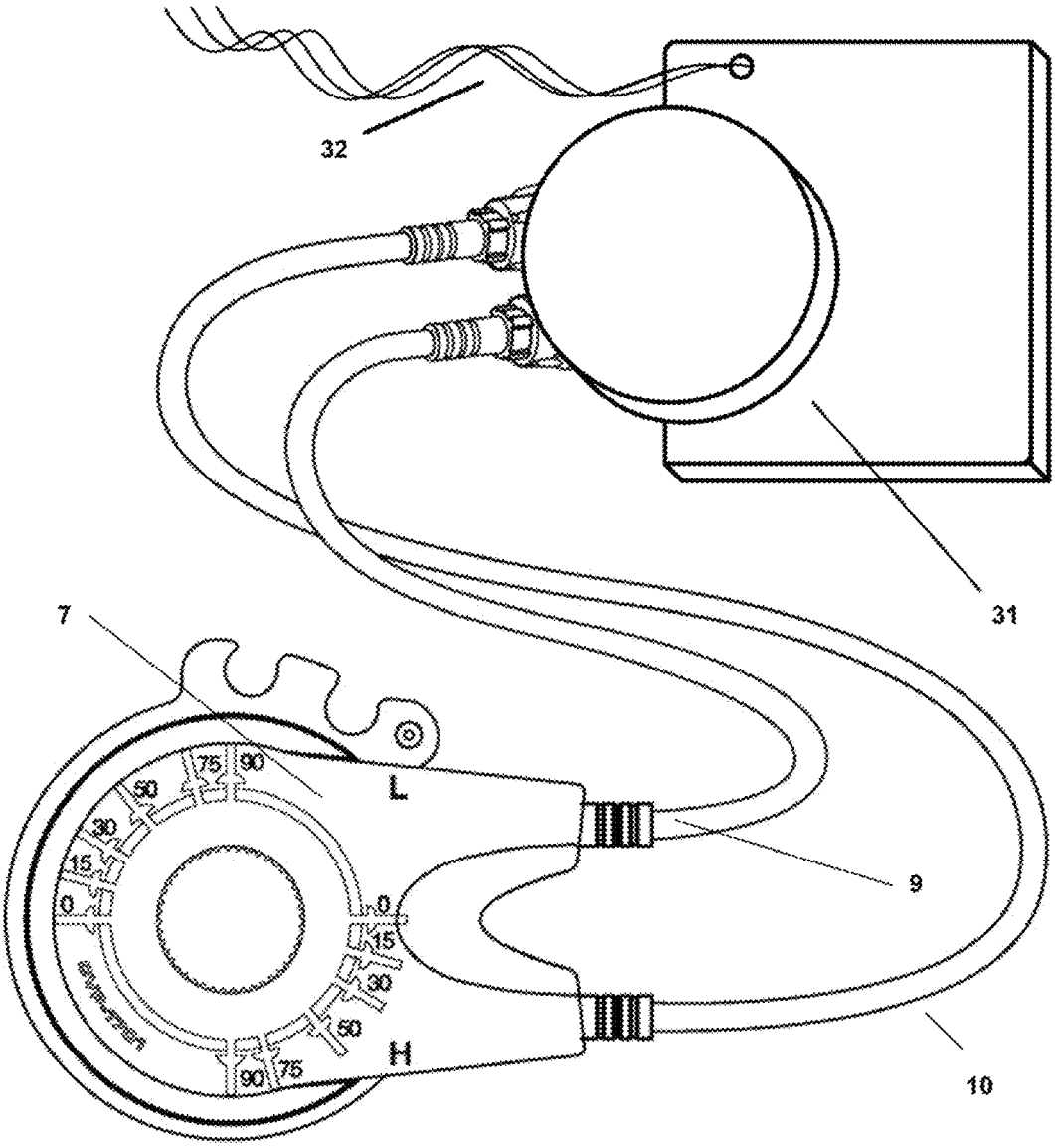
FIG. 19 is another partially enlarged view of the preferred embodiment of the movable user interface, the Bowden cable, and the transmission ratio selector input control of the stationary exercise equipment according to the present invention.

Referring to FIGS. 18 and 19, the movable user interface (42) is linked to the transmission ratio selector input control (7) via two Bowden cables (9/10) for controlling the transmission ratio. It is noted that, the movable user interface (42) can also be a servo controlled transmission ratio control unit (31) with the servo controlled transmission ratio control unit wiring (32), as shown in FIG. 19.

Figure 20:
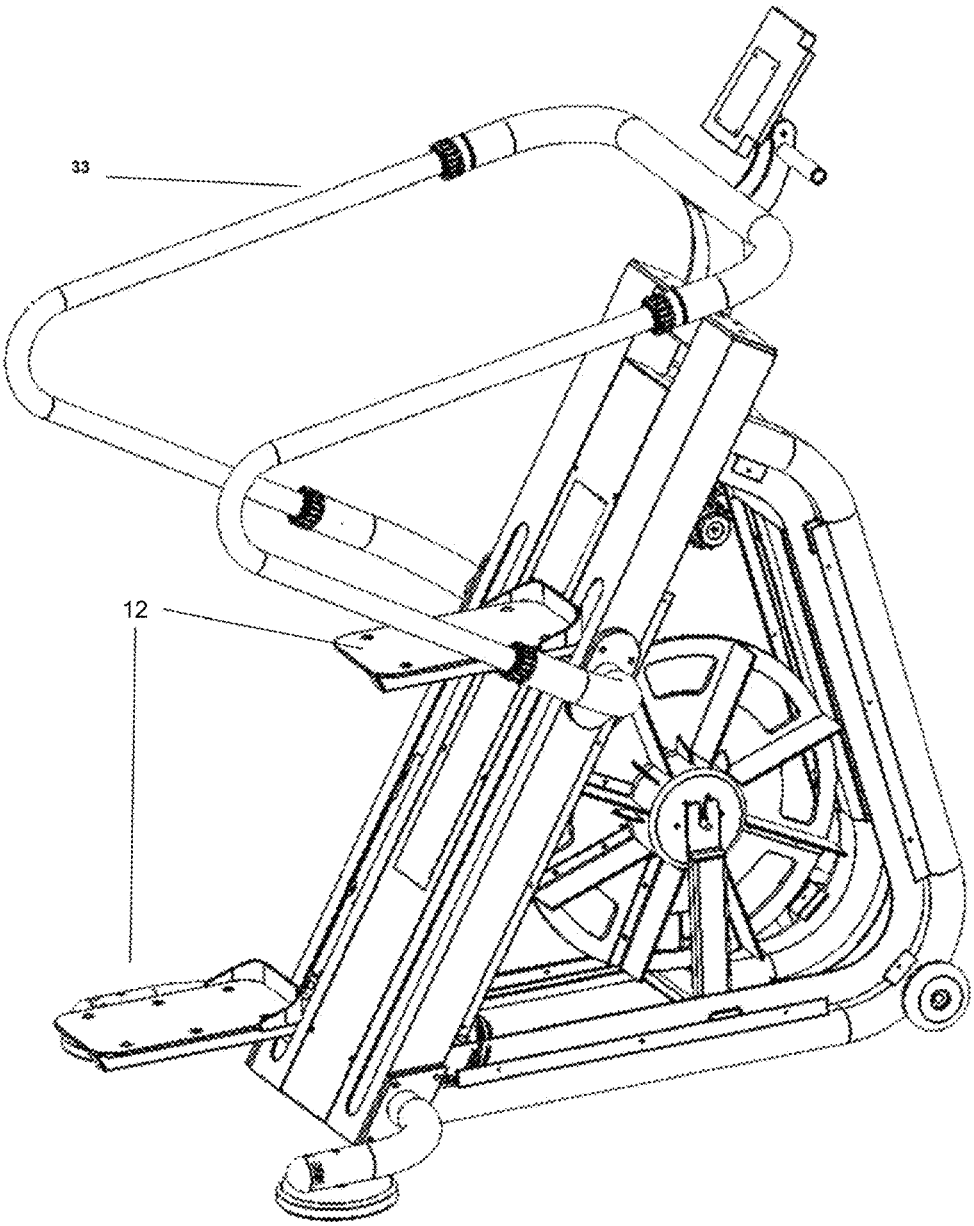
FIG. 20 is a schematic view of another preferred embodiment of the stationary exercise equipment according to the present invention.
Figure 21:
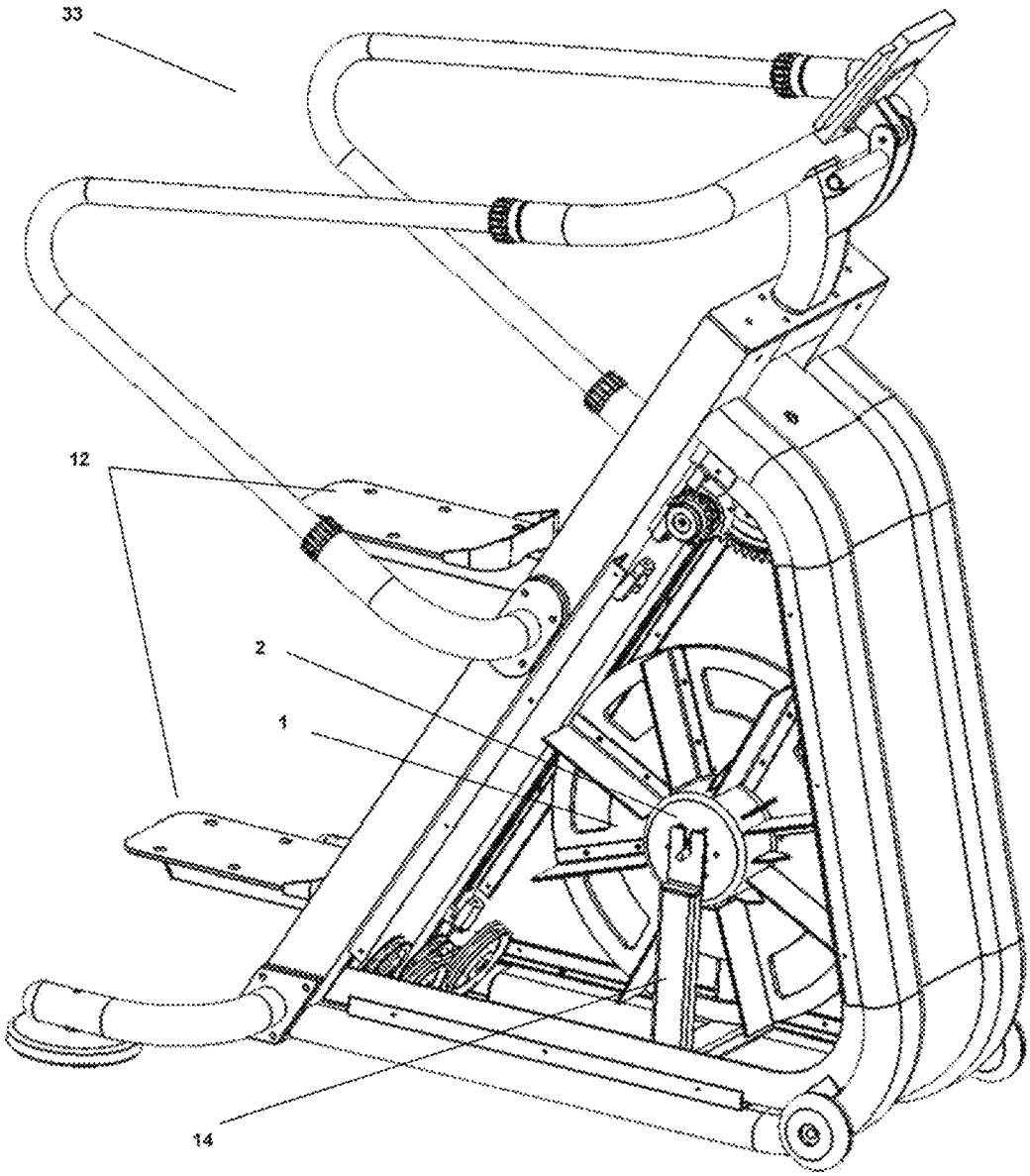
FIG. 21 is a another schematic view of another preferred embodiment of the stationary exercise equipment according to the present invention.
Figure 22:
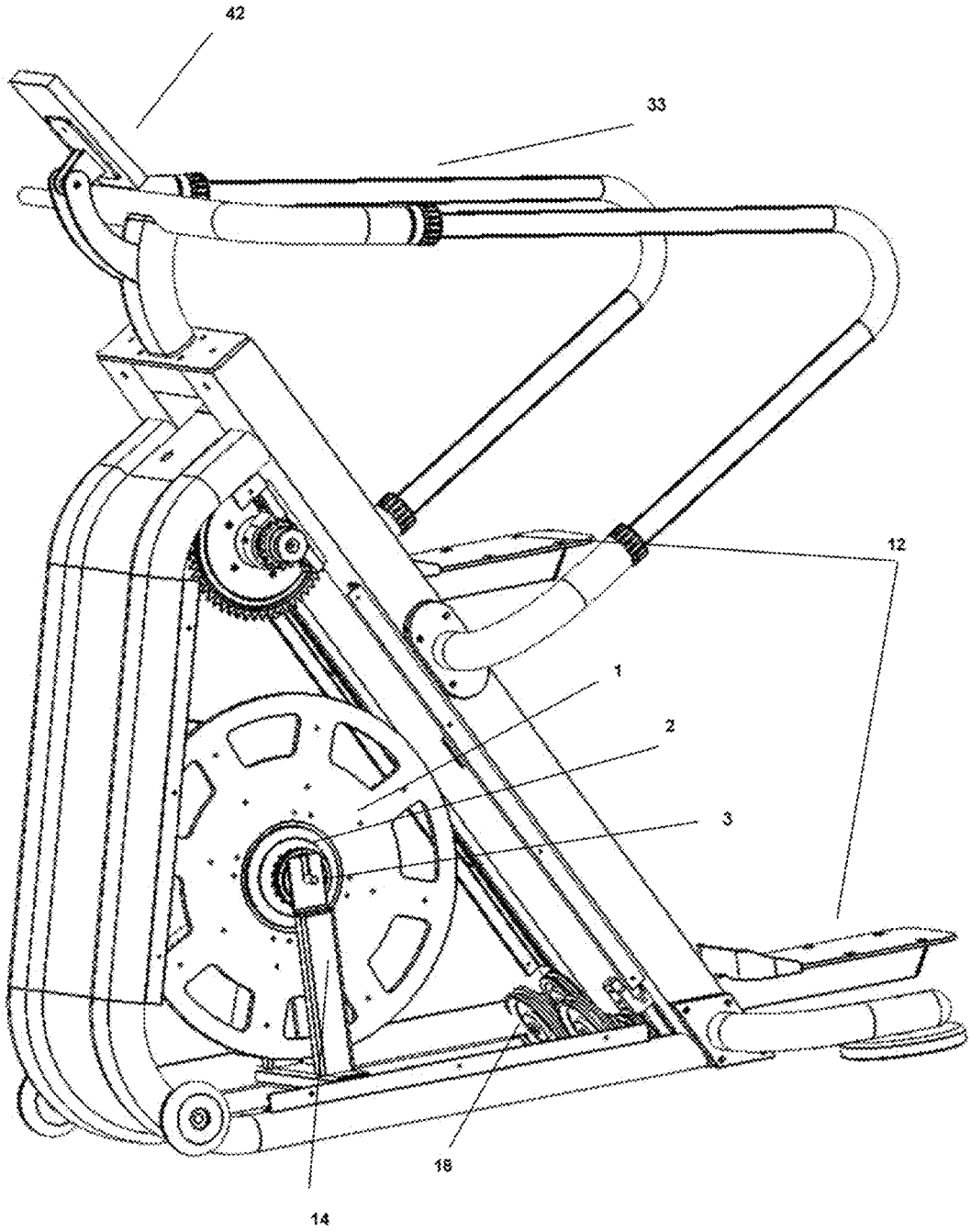
FIG. 22 is still another schematic view of another preferred embodiment of the stationary exercise equipment according to the present invention.
Figure 23:
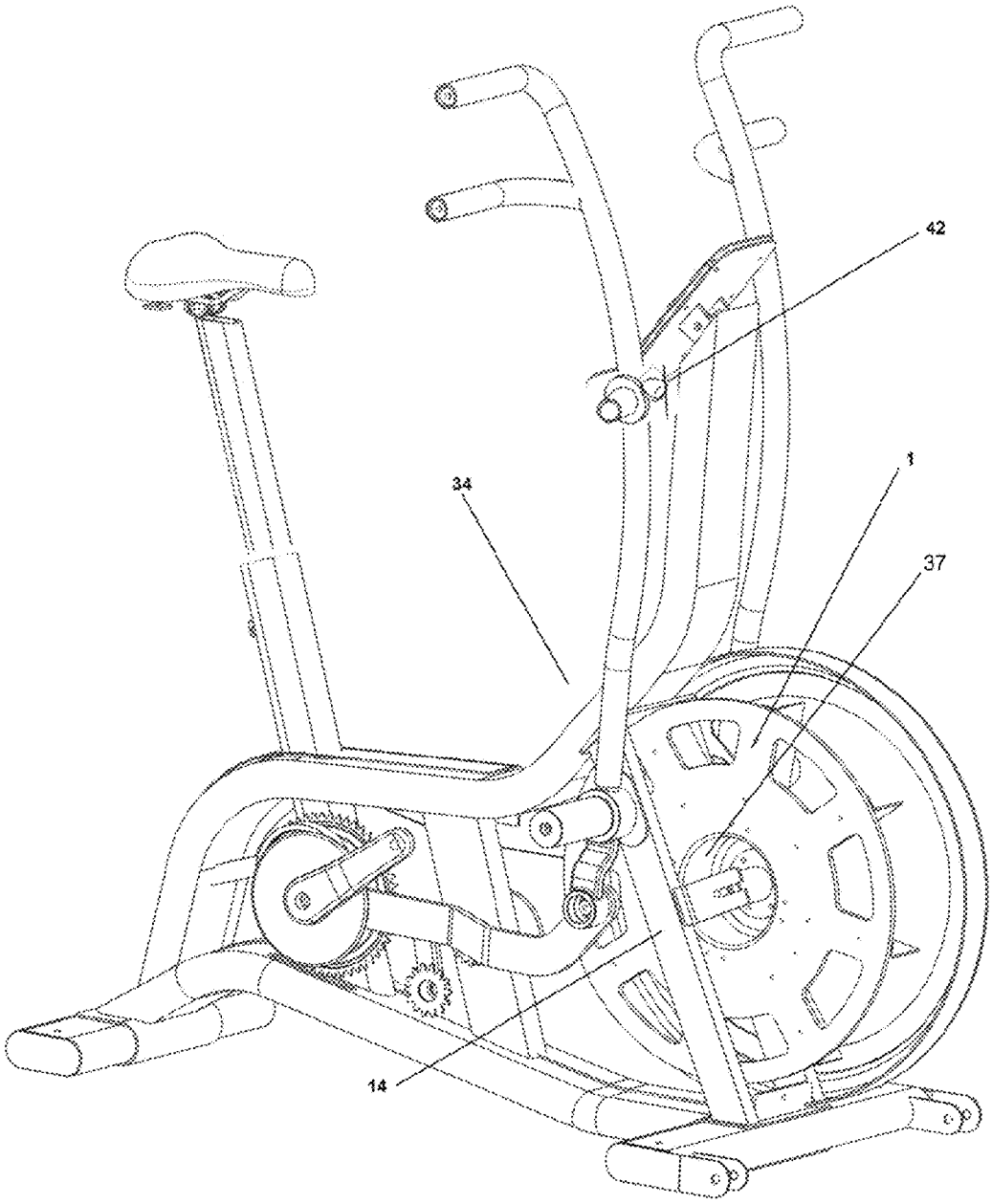
FIG. 23 is a schematic view of still another preferred embodiment of the stationary exercise equipment according to the present invention.
Figure 24:
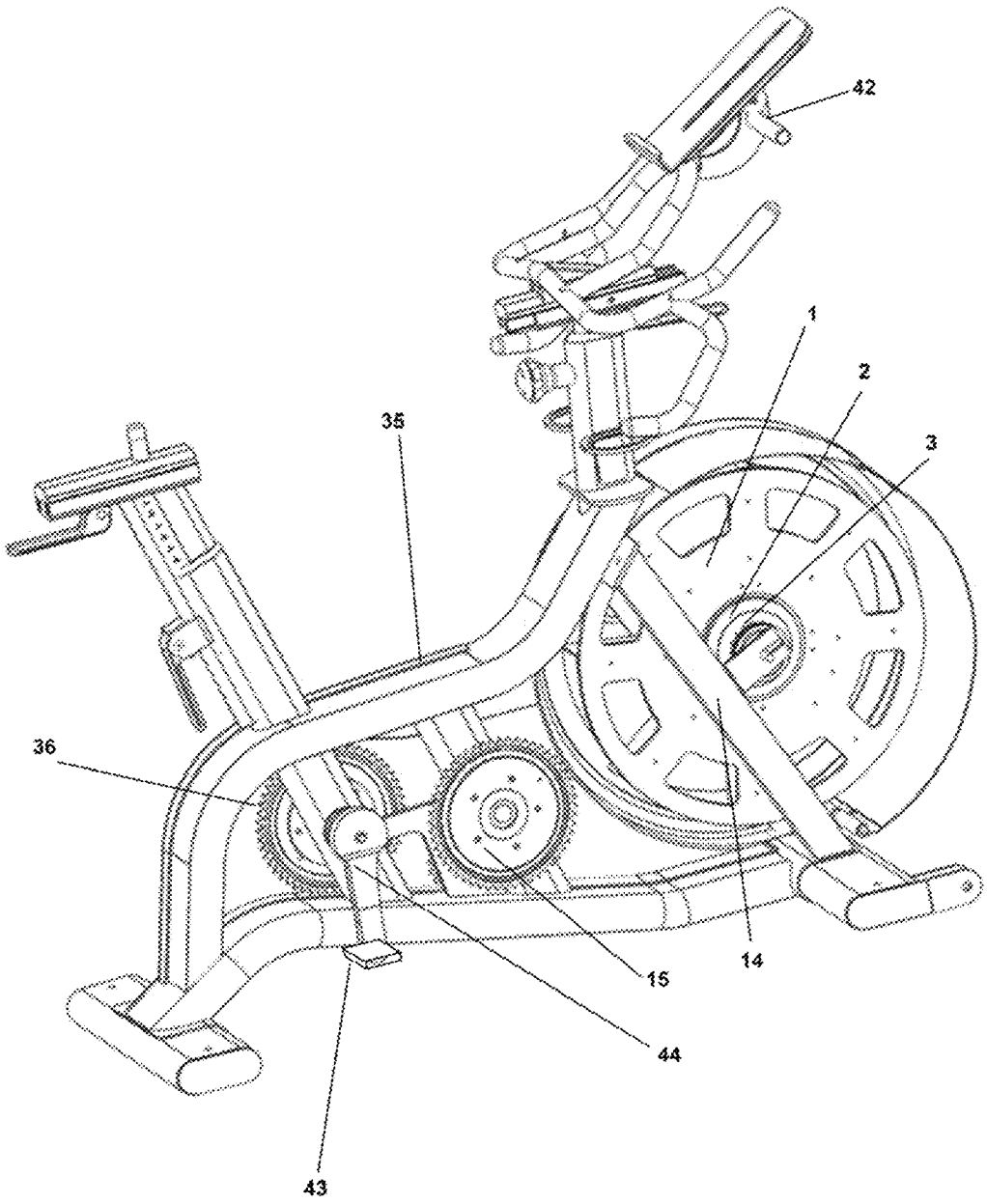
FIG. 24 is another schematic view of still another preferred embodiment of the stationary exercise equipment according to the present invention.
Figure 25:
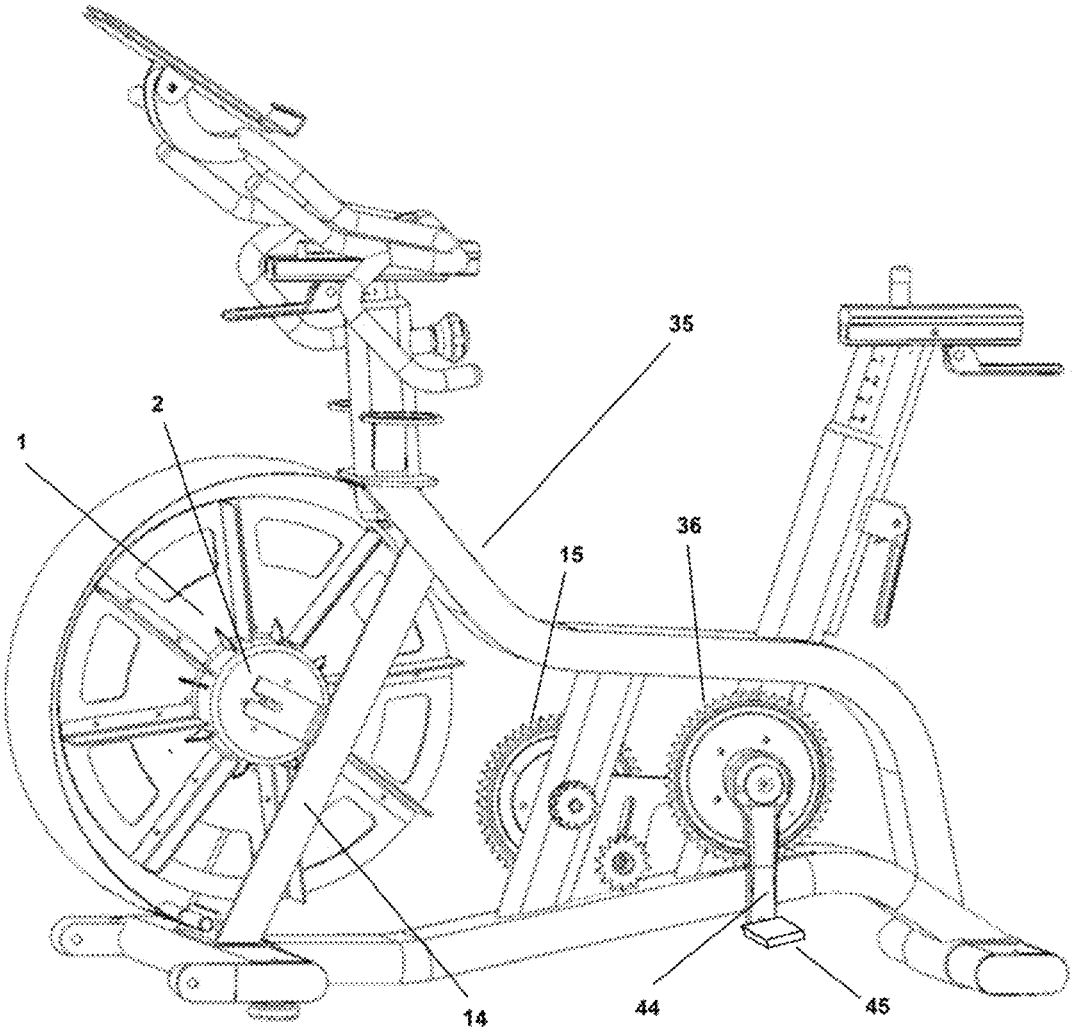
FIG. 25 is still another schematic view of still another preferred embodiment of the stationary exercise equipment according to the present invention.
Figure 26:
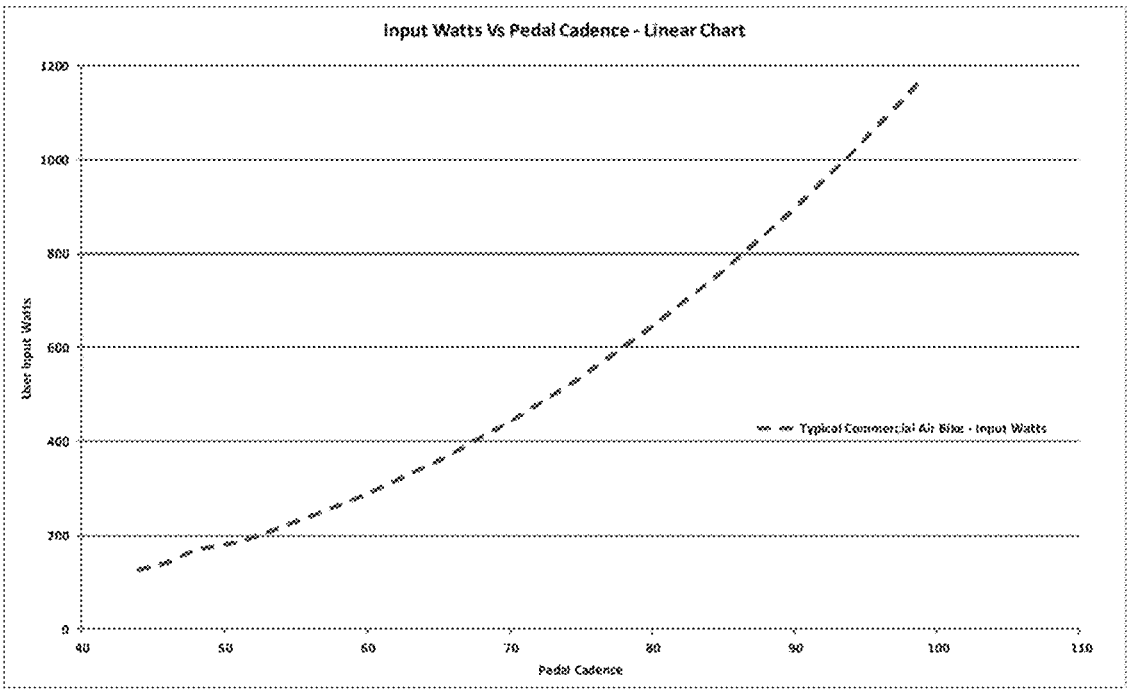
FIG. 26 shows the pedal cadence verses user input watts relationship power curve for a commercial gym sample air displacement stationary exercise cycle.
Figure 27:
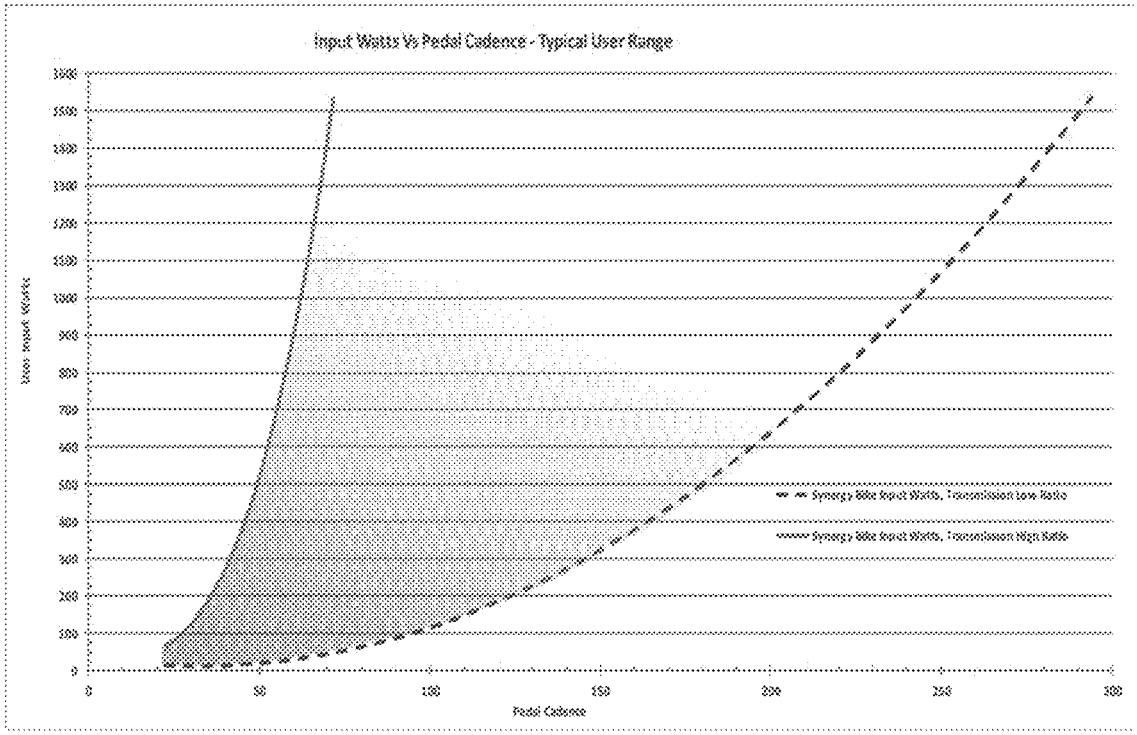
FIG. 27 shows the pedal cadence verses user input watts relationship power range for a typical user of using the stationary exercise equipment according to the present invention.
Figure 28:
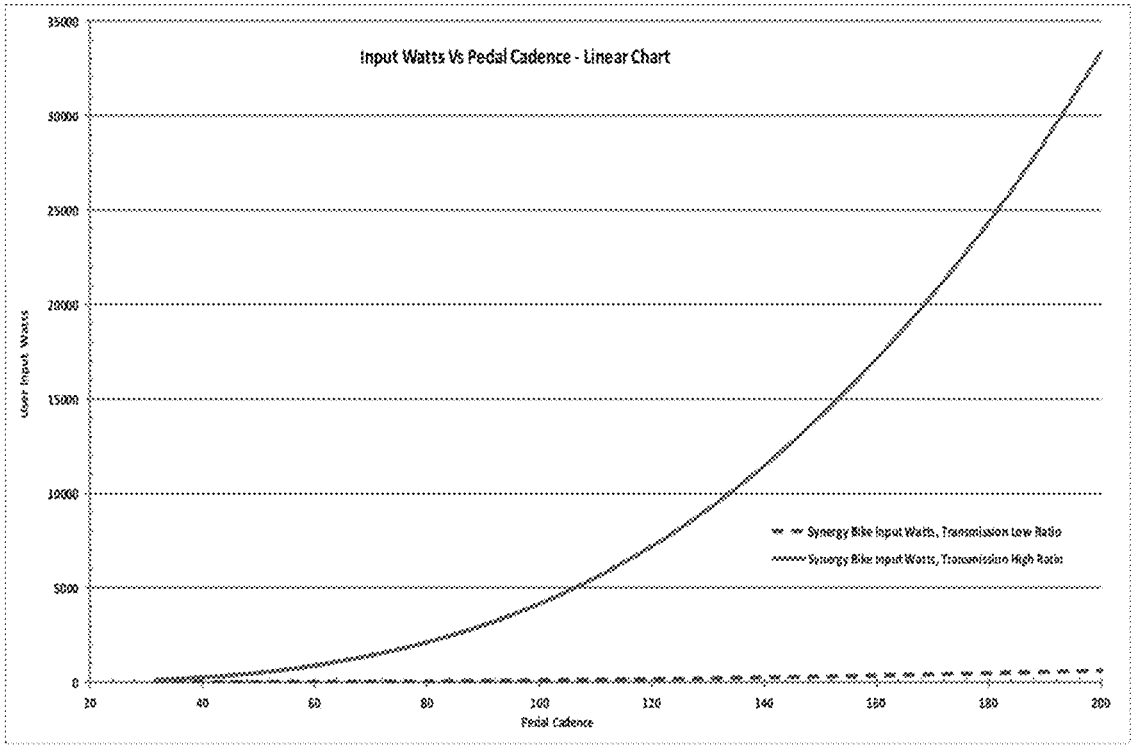
FIG. 28 shows the pedal cadence verses user input watts linear relationship power curves for a pedal cadence up to 200 RPM for both maximum and minimum transmission ratios of the stationary exercise equipment according to the present invention.
Figure 29:
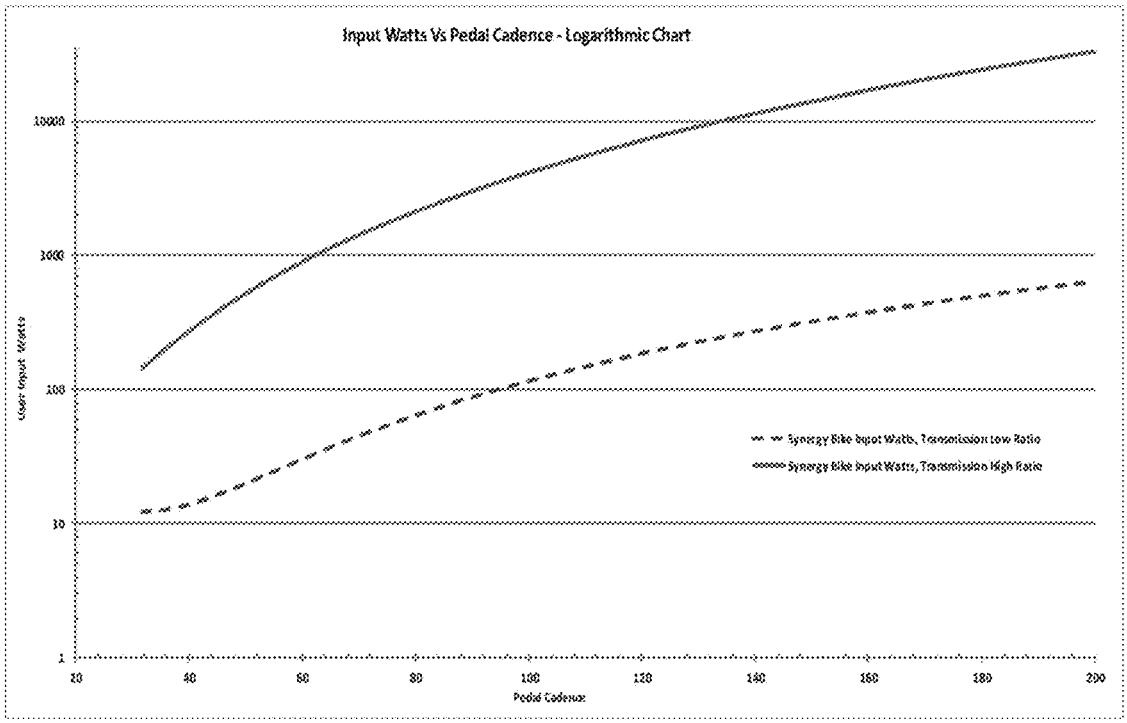
FIG. 29 shows the pedal cadence verses user input watts logarithmic relationship power curves for a pedal cadence up to 200 RPM for both maximum and minimum transmission ratios of the stationary exercise equipment according to the present invention.

Referring to FIGS. 20 to 25, which are other preferred embodiments of the stationary exercise equipment according to the present invention. FIGS. 20 to 22 show climber equipment (33). The foot plates (12) travel at an angle of 60° along sliding rails of the support structure. FIG. 23 shows bike equipment (34). FIGS. 24 and 25 show power cycle equipment (35). A right foot pedal (43), a left foot pedal (45), crank arms (44) and a crank sprocket (36) is further provided in the power cycle equipment (35).

Referring to FIGS. 26 to 29, the significant difference when compared to other machines is that very light loads are available for very high input speeds whilst extraordinarily high load are available with low to modest speeds. This is beyond the capability of any other fluid (air, liquid or both) displacement machine or machines. The graph in FIG. 27 charts the measured relationship between pedal cadence and energy input for both maximum and minimum transmission ratios, for the present invention. The Typical User power band shows that a comfortable power setting is available for any user. The graph in FIG. 28 charts the linear relationship between pedal cadence and energy input for the present invention, for both minimum and maximum transmission ratios, up to a cadence of 200 RPM. It can be seen that the very wide range provides a load that is very light for a low transmission ratio and very high for a high transmission ratio. The user can choose an input speed and load for any point between the two curves. The graph in FIG. 29 charts the logarithmic relationship between pedal cadence and energy input for the present invention, for both maximum and minimum transmission ratios, up to a cadence of 200 Strokes Per Minute. It can be seen that the very wide range provides a load that is very light for a high transmission ratio and very high for a low transmission ratio. The user can choose an input speed and load for any point between the two curves. It can be seen that the traditional exercise machine can only provide single exercise intensity for the user (FIG. 26), while the stationary exercise equipment according to the present invention can provide different exercise intensity for different users (FIGS. 27 to 29), so that an elite athlete or a novice can both find an exercise intensity suitable for them.

According to those features described above, the unique integration of a remotely controlled CVT with fluid displacement resistance facilitates significantly lower workout loads than would normally be possible, whilst at the time facilitating exponentially higher potential workout loads than what is possible on any other existing ergometer. This occurs because of the unique cubed relationship between speed and power that is characteristic of fluid resistance. The already exceptionally high power/resistance range that already normally exists with fluid resistance, is now exponentially increased because of the cubed multiplier effect of under gearing and over gearing the fluid displacement flywheel or turbine. Therefore using a CVT with a gearing ratio of say 1:3.6 (as tested and referred to for data in this specification) increases or decreases the normal workload/power created by a fluid resistance turbine at given point by a factor of 46.656 (3.6 cubed). Thus, it can be known that the transmission can be adjusted to suit any user from the novice and rehabilitation client to the elite athlete, by a simple adjustment of the transmission ratio. The initial system transmission ratios, from user interface to turbine, are designed to be comfortable to the beginning user. The advantage of using the user controlled, turbine hub mounted, Continuously Variable Transmission (CVT) between the driven turbine and the driving source is that the degree of difficulty of powering the turbine can be incrementally adjusted to suit the fitness and ability level of any user, thus simplifying and vastly improving the accuracy and repeatability of performance measurement, whilst providing a more enjoyable and comfortable workout for any user. Finding and maintaining the perfect load and cadence for the user is easy, smooth and spontaneous.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A stationary exercise equipment, comprising:

a supporting structure;

a force-resisting device situated inside the supporting structure;

a hub mounted continuously variable transmission installed on the force-resisting device;

a movable user interface installed on the supporting structure for controlling a transmission ratio;

a main shaft penetrating through a main sprocket, two ends of the main shaft being sleeved with a first sprocket and a second sprocket, respectively;

a plurality of front pulleys and a plurality of rear pulleys;

a first flexible cable fed to the plurality of front pulleys and a second flexible cable fed to the plurality of rear pulleys;

a first chain and a second chain, one end of the first chain being coupled to one end of the first flexible cable and another end of the first chain being coupled to one end of the second flexible cable, and one end of the second chain being coupled to another end of the first flexible cable and another end of the second chain being coupled to another end of the second flexible cable; and a third chain engaging the main sprocket and the hub mounted continuously variable transmission;

wherein the first and the second chains engage the first sprocket and the second sprocket respectively to drive the main sprocket, so that the third chain engaging the main sprocket and the hub mounted continuously variable transmission can be driven to bring the force-resisting device into rotation.

2. The stationary exercise equipment according to claim 1, wherein the force-resisting device further is a fluid displacement turbine.

3. The stationary exercise equipment according to claim 2, wherein the fluid displacement turbine is an air turbine or a liquid turbine.

4. The stationary exercise equipment according to claim 1, wherein a center of the force-resisting device concaves to form an accommodation space, and the hub mounted continuously variable transmission is accommodated therein.

5. The stationary exercise equipment according to claim 1 further comprising a transmission input unidirectional clutch, a transmission input drive sprocket, a plurality of transmission ratio selector input control spacers, a transmission ratio selector input control, and a transmission ratio selector collar sequentially and coaxially sleeved on a transmission input shaft spline toward the hub mounted continuously variable transmission.

6. The stationary exercise equipment according to claim 5, wherein a center of the transmission input drive sprocket is a formed hollow section with a tooth shape outer periphery.

7. The stationary exercise equipment according to claim 6, wherein an outer periphery of the transmission input unidirectional clutch is protruded to form a plurality of convex parts which are corresponding to the tooth shape outer periphery of the hollow section of the transmission input drive sprocket, so that the transmission input drive sprocket and the transmission input unidirectional clutch can rotate simultaneously after being assembled.

8. The stationary exercise equipment according to claim 7, wherein the third chain engages the main sprocket and the transmission input drive sprocket, so that when the main shaft is driven to rotate by the first sprocket and the second sprocket, the main sprocket can rotate accordingly to simultaneously drive the transmission input drive sprocket via the third chain.

9. The stationary exercise equipment according to claim 1, wherein the hub mounted continuously variable transmission is controlled and driven manually, remotely, electrically, hydraulically, pneumatically, or combinations of thereof.

10. The stationary exercise equipment according to claim 1, wherein the movable user interface is a transmission ratio control knob with a difficulty display.

11. The stationary exercise equipment according to claim 1, wherein the movable user interface is an electric transmission ratio control panel with a difficulty display.

12. The stationary exercise equipment according to claim 1, wherein the movable user interface is a wireless transmission ratio control panel with a smart phone controller.

* * * * *